US006591535B2

(12) United States Patent
Reynolds

(10) Patent No.: US 6,591,535 B2
(45) Date of Patent: Jul. 15, 2003

(54) LIGHT WEIGHT WEAPON OPERATING SYSTEM AND CARTRIDGE FEED

(75) Inventor: George L. Reynolds, Altona, IL (US)

(73) Assignee: Armalite, Inc., Geneseo, IL (US)

( * ) Notice: Subject to any disclaimer, the term of this patent is extended or adjusted under 35 U.S.C. 154(b) by 0 days.

(21) Appl. No.: 09/939,266

(22) Filed: Aug. 24, 2001

(65) Prior Publication Data

US 2003/0089018 A1 May 15, 2003

Related U.S. Application Data

(60) Provisional application No. 60/227,761, filed on Aug. 24, 2000.

(51) Int. Cl.[7] ..... F41C 27/06
(52) U.S. Cl. ..... 42/105; 42/17
(58) Field of Search ..... 42/17, 19, 105; 89/169, 164, 190

(56) References Cited

U.S. PATENT DOCUMENTS

| | | | | | |
|---|---|---|---|---|---|
| 36,174 | A | * | 8/1862 | Scott | 42/19 |
| 45,466 | A | * | 12/1864 | Appleby | 42/19 |
| 49,409 | A | | 8/1865 | Hughes et al. | |
| 210,294 | A | * | 11/1878 | Burgess | 42/19 |
| 210,295 | A | * | 11/1878 | Burgess | 42/17 |
| 212,105 | A | * | 2/1879 | Merriam | 42/7 |
| 447,836 | A | * | 3/1891 | Maxim | 42/19 |
| 638,677 | A | | 12/1899 | Alfson | |
| 1,270,293 | A | * | 6/1918 | Hoexter and Shaw | 42/105 |
| 2,655,754 | A | | 10/1953 | Brush | 42/50 |
| 2,690,024 | A | | 9/1954 | Brush | 42/17 |
| 3,395,478 | A | | 8/1968 | Harvey | 42/1 |
| 3,399,481 | A | * | 9/1968 | Giorgini | 42/87 |
| 3,404,477 | A | | 10/1968 | Silsby | 42/1 |
| 3,404,478 | A | | 10/1968 | Silsby | 42/1 |
| 3,416,252 | A | | 12/1968 | Silsby | 42/1 |
| 3,421,242 | A | | 1/1969 | Lizza | 42/25 |
| 3,431,820 | A | | 3/1969 | Chinn et al. | 89/161 |
| 3,435,549 | A | | 4/1969 | Kermode | 89/149 |
| 3,444,788 | A | | 5/1969 | Bates | 89/1.804 |
| 3,548,709 | A | | 12/1970 | Prince | 89/9 |
| 3,686,999 | A | | 8/1972 | Francois | 89/1 |
| 3,890,729 | A | * | 6/1975 | Frisoli | 42/18 |
| 3,901,126 | A | * | 8/1975 | Bretton | 42/17 |
| 4,019,424 | A | | 4/1977 | Reynolds | 89/137 |
| 4,527,459 | A | | 7/1985 | Childers | 89/161 |
| 4,821,442 | A | | 4/1989 | Bock | 42/17 |
| 5,052,144 | A | | 10/1991 | Ostor | 42/105 |
| 5,239,911 | A | | 8/1993 | Ostor | 89/33.1 |
| 5,284,081 | A | | 2/1994 | Stoner et al. | 89/33.17 |
| 5,691,497 | A | | 11/1997 | Weichert et al. | 89/1.4 |

* cited by examiner

*Primary Examiner*—Charles T. Jordan
*Assistant Examiner*—Denise J Buckley
(74) *Attorney, Agent, or Firm*—Woodard, Emhardt, Moriarty, McNett & Henry LLP

(57) ABSTRACT

A firearm is provided with a weapon operating system for firing large cartridges. The firearm may be a shoulder-fired, multi-shot, semiautomatic grenade launcher for firing grenade cartridges. The grenade launcher includes a magazine with a receptacle that holds one or more cartridges, a barrel, and a receiver coupled between the magazine and the barrel. The receiver includes a lightweight weapon operating system. Springs may be provided between the receiver and the magazine to isolate the receiver and barrel from the mass of cartridges in the magazine and the mounting resistance. A vernier feed system is disclosed for disengaging stacked cartridges in a tubular magazine from one another. A lifter based cartridge feed system is disclosed for magazine round control and/or chambering. A dwell is disclosed for retarding the breech lever after it has applied power to the accelerator lever during opening.

20 Claims, 16 Drawing Sheets

LIGHT WEIGHT WEAPON OPERATING SYSTEM AND CARTRIDGE FEED

CROSS-REFERENCE TO RELATED APPLICATONS

This application is a U.S. Patent Application based on and claiming priority to U.S. Provisional Patent Application No. 60/227,761, filed Aug. 24, 2000, the contents of which are herein incorporated by reference.

BACKGROUND OF INVENTION

The present invention relates generally to firearms, and more particularly to firearms for firing grenades and other large projectiles. Some grenades are chemical, dispensing tear gas or nausea gas. Other grenades eject flares for signaling, marking rounds with smoke, phosphorous for lighting fires, and regular high explosive grenades for anti-personnel and anti-armor purposes.

The United States Army adopted the 40 mm M79 grenade launcher in the early 1960's to provide the infantryman with an effective area-fire fragmentation weapon having a much greater range than possible with hand thrown grenades. Despite its effectiveness, the M79 is a single shot weapon limited to a low rate of fire. This low fire rate of single shot weapons can be a serious handicap because the grenadier is effectively disarmed while reloading the grenade launcher, providing the enemy an opportunity to attack or maneuver before the grenadier can further engage him. A further disadvantage with the M79 is that the rifle firepower of the infantry unit is reduced by one rifle.

Experienced grenadiers often do not use the weapon sights to establish a firing angle for the grenade launcher, but rather fire a first round at an angle of elevation based on experience. The grenadier observes the impact of this ranging round to make any required adjustment in the aim of the weapon at the target. Even though this technique is widely employed, it suffers from a disadvantage as employed with a single shot grenade launcher. The grenadier must lower the weapon to reload. Without exercising considerable skill, the weapon cannot be returned closely to its previous firing position to make the desired aiming correction, thus reducing the accuracy of the next fired round. Even if the grenadier can bring the target area under accurate fire, the delay between the ranging round and each succeeding round increases the time available for the target to take cover.

In order to address some of the problems associated with single shot weapons, the M203 grenade launcher attachment was developed for the M16 rifle. While the M16/M203 system provides the grenadier with rifle fire power in addition to grenade launching capabilities, the accuracy and grenade firing rate is degraded as compared to the M79 grenade launcher because of the increased weight and bulk of the combination weapon. In addition, the effectiveness of the M16 rifle attached to the grenade launcher is reduced.

Self powered weapon operating systems are commonly classified according to how energy is extracted from the propellant gases to operate the weapon. These systems can be classified as gas systems, recoil systems, and various types of blowback systems. These systems extract energy from the propellant gas and convert this gas into kinetic energy, which is imparted to the moving parts of the operating system. Weapon operating systems may also be classified according to the relationship of their primary and secondary masses. In gas, recoil and retarded blowback operating systems, most of the kinetic energy of the system is stored in a primary mass, typically called the bolt carrier or operating rod. The kinetic energy of the primary mass provides the energy for unlocking the secondary mass, which is typically called the bolt. After unlocking the secondary mass, the primary mass picks up the secondary mass and the two masses continue to recoil as a unit. Straight blow back weapons utilize only a primary mass.

Gas operated systems for grenade launchers are ineffective due to the internal ballistic characteristics of grenade cartridges. Grenade cartridges generate very low chamber pressure and a short pressure pulse. When coupled with the high expansion ratio of the cartridge, little gas pressure remains for operating the weapon.

Recoil operation of a shoulder fired grenade launcher presents difficulties because of the mount sensitivity of recoil operated systems especially since there is a low ratio of weapon mass to projectile mass in grenade launchers. Straight blowback operation for shoulder fired grenade launchers also presents difficulties because bolt recoil velocities cannot be kept within manageable limits without employing unacceptably massive bolts for a shoulder fired weapon.

There are also disadvantages associated with conventional retarded blowback operation of grenade launchers. The energy available for transfer to the operating mechanism in a retarded blowback operating system, as in a recoil system, depends on limiting receiver movement during firing, which is governed by the mounting resistance of the weapon. Grenade projectiles are relatively heavy when compared to the shoulder weapons in which they are fired; thus, grenade launchers are more sensitive to mounting resistance than are service rifles and machine guns. For example the M16 rifle weight to projectile weight ratio is about 800:1, and the M60 machinegun weight to projectile weight ratio is about 1000:1. In contrast, if a grenade launcher weighs 5 pounds, then the weapon to projectile weight ratio for a standard 40 mm grenade is about 13:1. This very low ratio associated with the grenade launcher is not conducive to reliable functioning in a conventional retarded blowback operating system. This is because the mounting resistance will vary greatly depending on whether the grenade launcher is held firmly against the shooter's body or away from the shooter's body, as well as the number of cartridges remaining in the magazine. If the receiver moves too far, then the receiver absorbs too much energy, thus reducing the energy available for driving the operating mechanism.

Multiple shot semi-automatic grenade launchers also have problems that relate to the recoil springs of the weapon. Conventional compression springs in weapon operating systems are limited to about 40 fps loading velocity; beyond which springs suffer from destructive spring surge. Therefore, the initial velocity of the bolt carrier must not exceed 40 fps.

A shoulder fired grenade launcher requires a relatively strong recoil spring to reliably chamber cartridges since the weapon is fired at high elevation angles and since the masses of a conventional bolt and of grenade cartridges are relatively large. This results in another problem associated with conventional box magazines relative to cartridge feeding and chambering grenade cartridges. A long overtravel for the bolt behind the top cartridge in the magazine is necessary to provide adequate time for the magazine follower spring to lift the cartridge stack to position another cartridge for chambering by the bolt. A relatively strong magazine follower spring must also be provided for adequate cartridge feeding. Additionally, a long chambering ramp is necessary which requires a long bolt travel, in spite of the next grenade cartridge typically being positioned as close as possible to the bore axis. Increasing the strength of the magazine follower spring causes the next cartridge in the magazine to exert a greater frictional or braking effect on the recoiling parts. Such compromises in the design of multiple shot grenade launchers using conventional magazines result in marginal reliability in cartridge feeding.

The relatively large mass of a grenade cartridge creates additional problems. An example of a multiple shot grenade launcher with a three chambered design is provided in U.S. Pat. No. 5,052,144. The grenade launcher of the '144 patent includes a sliding horizontal magazine serving as a firing chamber that aligns each cartridge to be fired with the barrel. Since this magazine is displaced off-axis relative to the bore, the center of gravity of the magazine changes with each shot, causing the grenade launcher to recoil about a different center of gravity. The magazine described in the '144 patent thus creates a different horizontal angle of departure for each shot relative to the line of sight, thus altering the point of impact of each projectile in azimuth.

While there have been attempts in the prior art to provide multiple shot grenade launchers, the need for improvements remains. Since the early 1960's, continuing governmental and private industry attempts have failed to field any shoulder fired multiple shot semi-automatic grenade launchers. One reason for this failure is that grenade cartridges are very difficult to feed from the weapon magazine to the chamber. Grenade cartridges are large in diameter, short, blunt, fragile and heavy. Grenade cartridges with their fragile projectile ogives require special system design considerations in order to deliver the cartridge to the weapon chamber with the projectile undamaged.

The ogives of grenade service projectiles and various grenade training projectiles are fragile because of the thin windshields covering their fuses. Dye marker practice rounds, that have thin and brittle plastic ogives designed to break easily on impact, often break when dropped on a hard surface. Conventional feed systems designed for hard and tough projectiles are not designed to protect projectiles from damage during feeding and chambering. Neither do conventional systems isolate cartridges in the magazine or cartridges in the feed system from the jarring caused by the recoil of firing.

Large capacity grenade cartridge magazines used with experimental shoulder fired grenade launchers are usually of the detachable box or drum magazine types that are temporarily attached to the weapon. When empty, a detachable magazine is replaced with another loaded magazine. Placement of a large capacity magazine below the grenade launcher renders the weapon very awkward for firing from the prone position. Conventional box or drum magazines on grenade launchers are also awkward and uncomfortable when carrying on the march whether the magazines are in or out of the weapon.

Detachable grenade launcher magazines are notoriously bulky because of the geometry necessary to accommodate large cartridges in box and drum type magazines. In addition to the space required for the cartridges themselves, space is also required for the magazine follower and follower spring, as well as for the magazine body itself. Detachable magazines represent a substantial parasitic weight in the logistics system as well as in the ammunition burden of the soldier. Other types of grenade launcher magazine designs such as those using endless chains or belts are even more bulky for the number of cartridges carried. Such bulky magazines are very awkward for the soldier when aboard vehicles and for carrying into combat. Additionally, detachable magazines for grenade launchers are expensive.

The present invention is directed towards meeting some or all of the needs mentioned above while addressing some or all of the deficiencies discussed above.

SUMMARY OF THE INVENTION

The present invention is directed to, among other features, a weapon operating system that has application with grenade launchers and other devices for firing low pressure cartridges. The weapon operating system of one form of the present invention includes a breech lever and an accelerator lever, that transfer the recoil forces to the primary mass, such as an operating slide. The levers are disconnected from the primary mass as the primary mass recoils in the firearm. Thus the present invention does not require consideration of a secondary mass pick-up in the weapon operating system design. The design of the operating system mass requirement of the present invention may be based solely upon weapon cycling requirements since the ratio of the primary mass to secondary mass is not a design consideration. This permits a lighter weapon operating system.

In another form of the present invention, there is provided a weapon operating system that uses the energy provided from firing low pressure grenade cartridges. Low pressure grenade cartridges operate at very low chamber pressure with a short pressure pulse even though the recoil pulse is substantial. The recoil force from firing the chambered cartridge is transmitted to the weapon operating system. The weapon operating system includes a breech pad in communication with the cartridge. The breech pad is connected to a breech lever. The breech lever contacts an accelerator lever, and moves the accelerator lever when the cartridge is fired. The accelerator lever drives an operating slide provided with an extractor and a rammer. The extractor removes the spent cartridge from the chamber for ejection. The rammer picks up a second cartridge at the rear of the recoil stroke and positions the second cartridge in the chamber. Since the operating system does not require a bolt or bolt carrier, the mass of the recoiling parts is lowered significantly. Lower mass in the recoiling parts, in turn, increases the ratio of the mass of the weapon to the mass of the recoiling parts which inherently improves functional reliability.

In one form of the present invention, the breech lever is hinged off the barrel axis and perpendicular to the barrel axis. The accelerator lever is also hinged off the barrel axis opposite the breech lever hinge and perpendicular to the barrel axis. When the cartridge is fired, the breech lever and accelerator lever are each pivoted about their respective hinges and the breech lever and accelerator lever are swung away from the barrel axis and de-coupled from the operating slide during the recoil cycle.

According to another form of the present invention, there is provided a grenade launcher with a weapon operating system that addresses one or more concerns relating to the mounting resistance of the grenade launcher. In contrast to rifles and machineguns, grenade projectiles are relatively heavy when compared to grenade launcher weight. The operating system of the present invention transmits the recoil force from firing the cartridge through two levers and into a primary mass which is of relatively low mass as compared to overall weapon weight. In one specific embodiment, the empty weight of the weapon without the primary mass is about 4.25 lbs., and the primary mass weighs about 0.75 lbs. Since the primary mass is the only recoiling part of the weapon, the weight ratio of the weapon less recoiling parts to recoiling parts is about 5.66:1. This ratio is higher than would be found in a grenade launcher that has a secondary mass coupled to and recoiling along with the primary mass. The higher ratio of the present invention makes the grenade launcher less sensitive to changes in the mounting resistance provided by the shooter and the weight of cartridges in the magazine.

According to yet another feature of the present invention, there is provided a grenade launcher with springs between the receiver and the magazine housing that isolate the receiver and barrel from solid bearing against the magazine housing and the mounting resistance of the shooter. When the weapon is solidly mounted against the shoulder of the shooter and a cartridge is fired, the springs compress to permit the barrel and receiver group to recoil approximately as a free body relative to the magazine housing and the mounting resistance. If the grenade launcher is fired without mounting resistance, the entire weapon recoils as a free body. The grenade launcher is less sensitive to the mass of the cartridges remaining in the magazine and the mounting resistance provided by the shooter since the receiver and barrel are isolated from the magazine and mounting resistance. While isolating the magazine using these springs decreases the effective mass ratio of weapon plus projectile, the resultant mass ratio is effectively made more uniform between various mounting conditions.

According to another form of the present invention there is provided a magazine for retaining a column of grenade cartridges. Each cartridge of the column of cartridges has a nose and a tail, the tail defining a cartridge rim. The magazine has at least one interior surface defining a bore for retaining the column of cartridges. The interior surface extends along an axis between a front end and a rear end. The column of cartridges is stacked nose to tail substantially along the axis so that the nose of each cartridge points toward the front end. The magazine also has a magazine follower positioned at the rear end of the magazine for pushing the column of cartridges toward the front end. The magazine further includes a vernier member having a plurality of cartridge locators. The vernier member rides on a plurality of pins such that the vernier member is movable within the bore from a first position to a second position. In the first position the plurality of cartridge locators are disengaged from the column of cartridges. In the second position at least some of the cartridge locators engage the column of cartridges and displace the cartridges so engaged from contacting one another.

According to yet another form of the present invention there is provided a positive round control system for a grenade launcher. The positive round control system comprises a slide, cartridge carrier, carrier drive and drive pawl. The slide extends between a forward end and a back end. The slide has a recess substantially adjacent the rear end. The slide moves forward and back substantially along a bore axis of the grenade launcher. The cartridge carrier includes a lifter and at least one cartridge locator for securing a cartridge. The carrier drive is pivotally connected to the cartridge carrier by a carrier pin. The drive pawl is pivotally connected to the carrier drive and engages the recess of the slide during at least a portion of forward motion of the slide along the bore axis. The cartridge carrier is pivotally connected to a carrier link by a link pin so that the carrier drive and the cartridge carrier and the carrier link pivot around the link pin as a functional unit as the slide moves forward and the recess of the slide engages the drive pawl. The functional unit aligns the cartridge secured by the cartridge carrier on the bore axis of the grenade launcher. These and other features, aspects, embodiments, and advantages, including the cartridge feed mechanism and the cartridge magazine of the weapon, will be discussed further below.

DESCRIPTION OF THE ILLUSTRATED EMBODIMENTS

Figure 1:
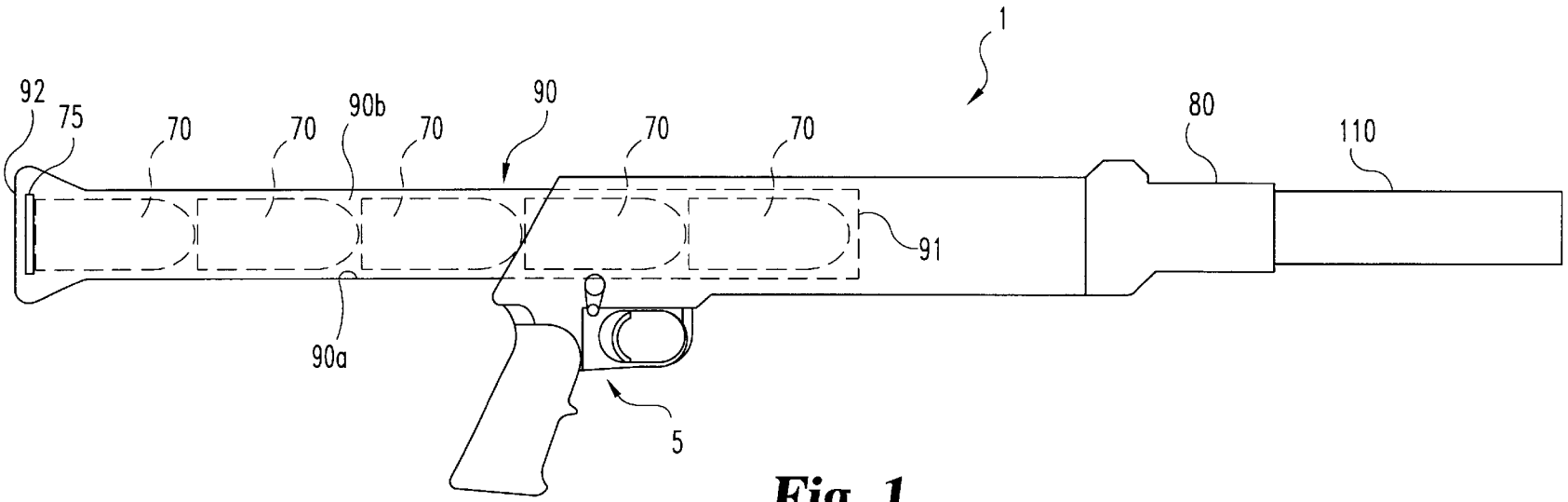
FIG. 1 is a side elevation view of a grenade launcher according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated therein are contemplated as would normally occur to one skilled in the art to which the invention relates.

In FIG. 1, there is illustrated a shoulder fired, multi-shot, semi-automatic grenade launcher 1. Grenade launcher 1 includes a barrel 110, a combination magazine and butt stock 90, and a receiver 80 therebetween. A handgrip/trigger mechanism 5 is secured to receiver 80. The magazine 90 has an interior surface 90*a* defining a bore 90*b* extending between a front end 91 and a rear end 92. The bore 90*b* retains a column of cartridges 70 stacked nose to tail. The magazine 90 has a magazine follower 75 driven by a spring (not illustrated) to push the column of cartridges toward the receiver 80 adjacent the front end 91. Grenade launcher 1 provides capabilities for high rates of fire of grenade rounds which increases the possible number of rounds fired per unit of time. Multi-shot grenade launcher 1 also provides a significantly higher hit probability per round since the grenadier can maintain the weapon's aim at the target while observing the fall of shot since reloading after each shot is not required. This permits the grenadier to concentrate on the target rather than reloading, facilitating any adjustments in aim that may be required. The grenadier can also quickly select another target or blanket the original target with some or all of the remaining rounds, if desired.

Figure 2:
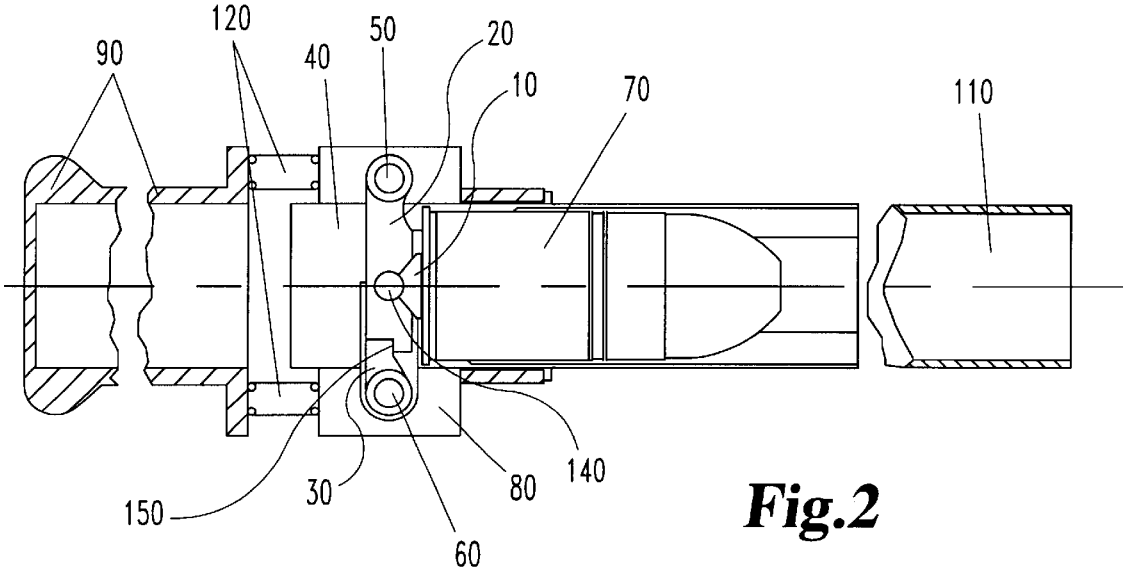
FIG. 2 is a side plan view in partial section illustrating the mechanism in battery with a cartridge in the chamber and ready to fire.
Figure 4:
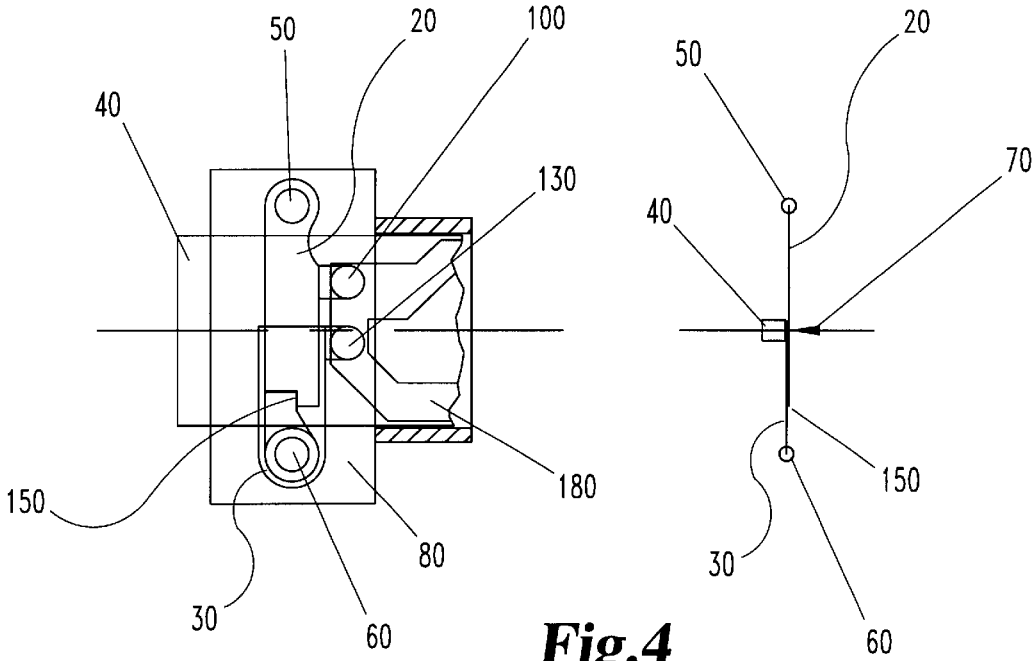
FIG. 4 is a partial side plan view in partial section, including a schematic, illustrating selected parts of the mechanism in the battery position.

Referring to FIG. 2, a cross-sectional view is taken through receiver 80. Cartridge 70 is supported in the chamber of barrel 110 by breech pad 10. Breech pad 10 is mounted to breech lever 20 by breech pad pivot 140. Breech lever 20 is mounted to receiver 80 by breech lever pivot 50. Accelerator lever 30 is mounted to receiver 80 by accelerator pivot 60. As illustrated in FIG. 4, accelerator lever 30 includes an accelerator lug 130. Operating slide 40 is in its battery position and resting against the accelerator lug 130, which cannot be seen in FIG. 2. Breech lever 20 is in contact with accelerator lever 30 at bearing point 150. It is contemplated that operating slide 40 for a 40 mm grenade launcher may have a weight similar to a bolt carrier or operating rod of a typical military service rifle.

Figure 3:
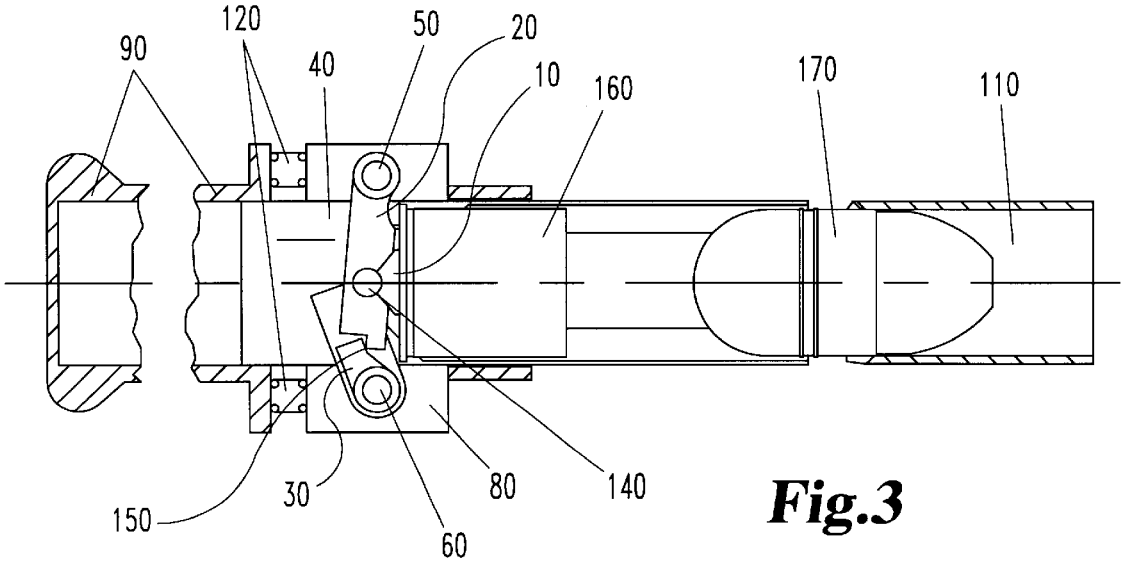
FIG. 3 is a side plan view in partial section illustrating the weapon fired, with the recoiling parts moving out of battery.

Referring now to FIG. 3, the cartridge has been fired by a conventional firing mechanism (not illustrated). Projectile 170 is being driven forward by the propellant gas, and the empty cartridge case 160 is being driven rearward. The recoil force of firing is being applied by the base of cartridge case 160 to breech pad 10 through breech pad pivot 140 to breech lever 20, through bearing point 150, to accelerator lever 30, through accelerator lug 130 to operating slide 40. Breech pad 10 rotates on breech pad pivot 140 to maintain the face of breech pad 10 flat against the base of cartridge case 160 as breech lever 20 rotates. Breech pad 10 transmits the recoil force to breech lever 20. Breech lever 20 is a third class lever with breech lever pivot 50 acting as the fulcrum. The force applied at breech pad pivot 140 applies work to accelerator lever 30 through bearing point 150. The motion of accelerator lever 30 at bearing point 150 is faster but with less force than at breech pad pivot 140.

Figure 5:
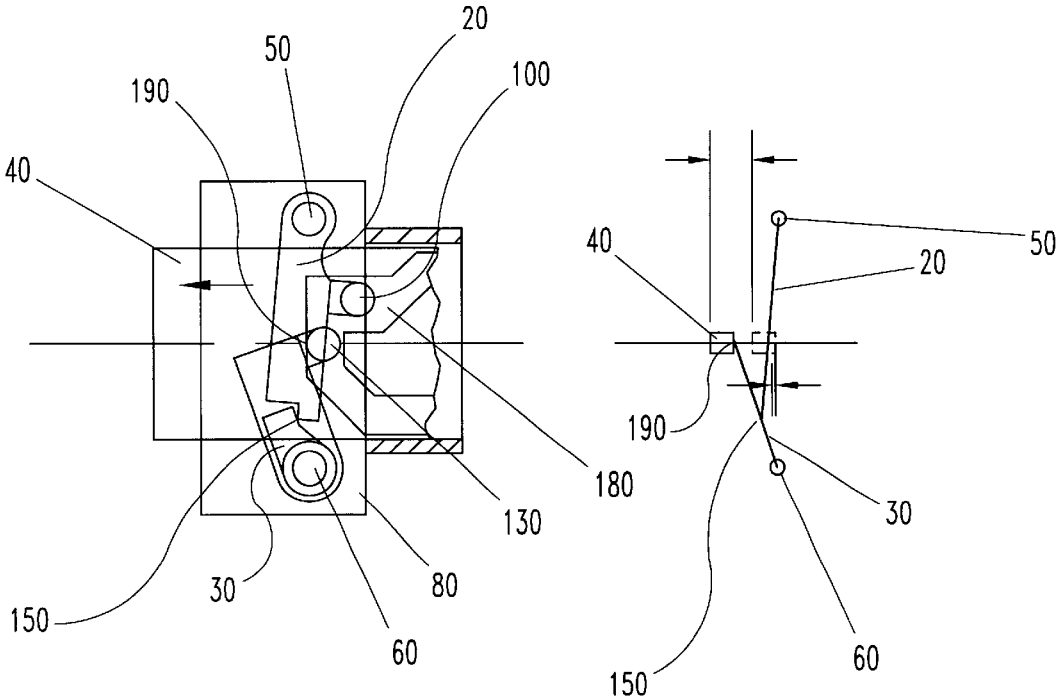
FIG. 5 is a partial side plan view in partial section, including a schematic, illustrating selected parts of the mechanism moving out of battery after firing.
Figure 6:
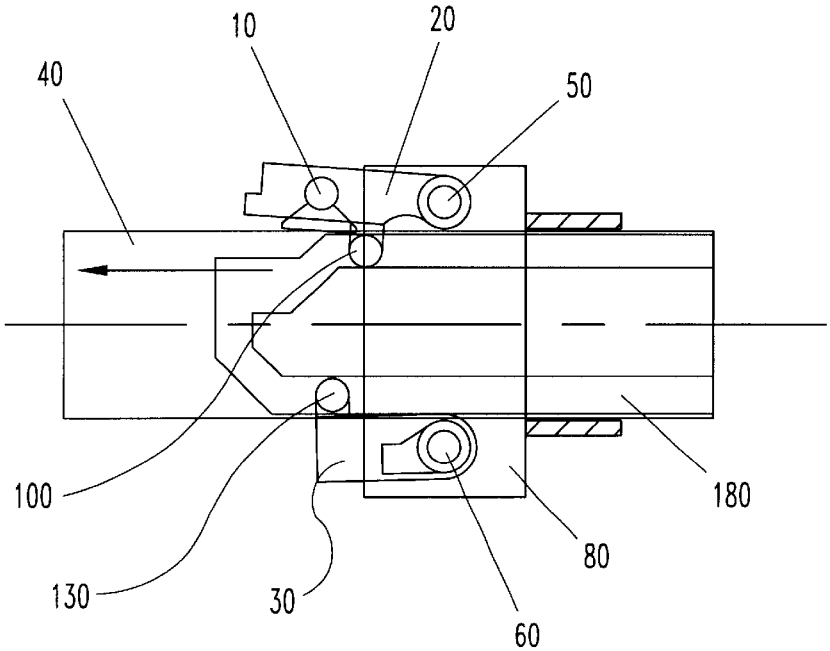
FIG. 6 is a partial side plan view in partial section illustrating selected parts with the breech fully open.

Accelerator lever 30 is also a third class lever with its fulcrum at accelerator pivot 60. The force applied to accelerator lever 30 at bearing point 150 rotates accelerator lever 30 about accelerator pivot 60, with the work applied to operating slide 40 through the accelerator lug 130 positioned in accelerator lug portion of cam path 180, as illustrated in FIGS. 4–6. Operating slide 40 is moving rearward at a higher velocity than breech pad 10 by a factor determined by the ratios of the lengths of the operating components of breech lever 20 and accelerator lever 30, and governed by the mass of operating slide 40 compared to the mass and velocity of projectile 170.

As illustrated in FIGS. 2–3, magazine/butt stock 90 is isolated from direct bearing against receiver 80 by recoil modulator springs 120. Part of the recoil forces of firing are delivered to receiver 80 through breech lever pivot 50 and accelerator pivot 60 compressing recoil modulator springs 120 against magazine/butt stock 90. The amount of compression of modulator springs 120 is governed by the inertial resistance of the mass of the magazine housing and its contents. If there is no ammunition in magazine/butt stock 90, the resistance will be less and the modulator springs 120 will compress less than if a fully loaded magazine is in magazine/butt stock 90.

Referring now to FIG. 4, the cartridge case and breech pad have been removed to illustrate more clearly the relationships of the breech lever 20, accelerator lever 30 and operating slide 40. The parts are fully in the battery position. Accelerator lug 130 of accelerator lever 30, and breech lever lug 100 of breech lever 20 are engaged with operating slide 40 in the vertical component of cam path 180.

FIG. 5, similar to FIG. 4, illustrates the point in the operating cycle where firing has occurred and various components are being driven in recoil. Breech lever 20 has been forced to rotate rearward by propellant gas in the cartridge case (not illustrated), through the breech pad, which has been removed for clarity. Accelerator lever 30 is being forced to rotate by breech lever 20. Accelerator lug 130 of accelerator lever 30 is in contact with operating slide 40 at the operating slide contact 190, forcing the operating slide 40 to move rearward at a higher velocity than breech pad 10 by a factor determined by the ratios of the lengths of the operating components of breech lever 20 and accelerator lever 30, as governed by the mass of operating slide 40 compared to the mass and velocity of projectile 170 (not illustrated).

Referring now to FIG. 6, operating slide 40 is illustrated as continuing to move in recoil. Breech lever lug 100 is positioned in the breech lever portion of cam path 180 of operating slide 40, and accelerator lug 130 is positioned in and follows the accelerator lug portion of cam path 180 of operating slide 40. Breech lever 20 and accelerator lever 30 are rotated completely out of the path of the empty cartridge case (not illustrated) so the case may be fully extracted and ejected. Breech lever 20 and accelerator lever 30 will remain completely out of the path of the cartridge in the magazine until the next cartridge is fully chambered. Further features relating to alternative forms of the lugs and/or cam paths are discussed in greater detail below with respect to the dwell for retarding the breech lever illustrated and described below with respect to FIGS. 25–31.

Figure 7:
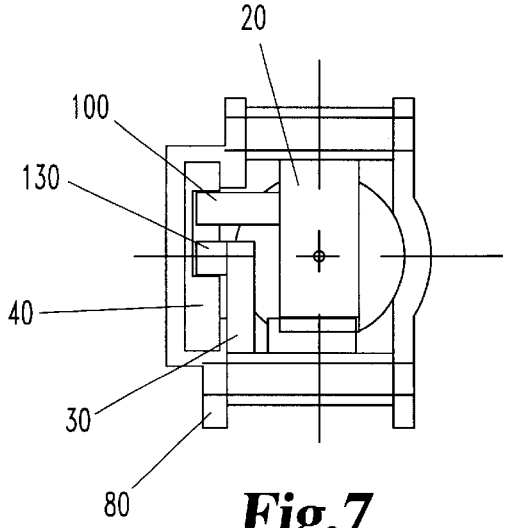
FIG. 7 is a plan view from the breech end of the weapon in partial section illustrating selected parts with the breech fully closed.

Referring now to FIG. 7, operating slide 40 is in its fully forward position. Breech lever 20 and accelerator lever 30 are in the full battery position as illustrated in FIGS. 2 and 4. Breech lever lug 100 of breech lever 20 and accelerator lug 130 of accelerator lever 30 are engaged with operating slide 40 in the vertical component of cam path 180 of FIG. 6.

Figure 8:
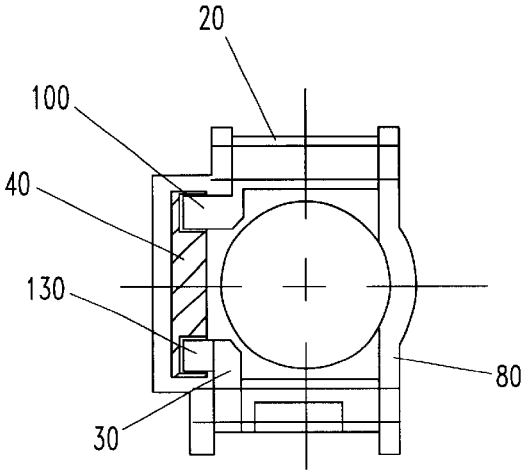
FIG. 8 is a plan view from the breech end of the weapon in partial section illustrating selected parts with the breech fully open.

Referring now to FIG. 8, operating slide 40 is moving rearward and breech lever 20 and accelerator lever 30 are in the fully open position, as illustrated in FIG. 6. Breech lever lug 100 of breech lever 20 and accelerator lug 130 of accelerator lever 30 are engaged with operating slide 40 in their respective portions of cam path 180 of FIG. 6. In this position, the breech is fully open for ejecting, and for chambering the next cartridge directly along the axis of the bore.

The projectile mass of a grenade cartridge is large compared to the weapon mass, and grenade cartridges are relatively blunt, which makes round control difficult in conventional cartridge feeding systems. In one form of the present invention (see FIG. 1), the cartridges are contained in a tubular magazine whose axis is preferably disposed exactly on the axis of the barrel. The next cartridge in the magazine is already on the bore axis in its fully fed position directly behind the chamber when the cartridge in the chamber is fired. The "fully fed" position is defined as the cartridge positioned ready to be chambered. After firing, the breech lever and accelerator lever swing completely out of the cartridge feed-way as the operating slide moves rearward in extraction and ejection. When the operating slide reaches its fully rearward position, a rammer (not illustrated) of the operating slide engages the fully fed next cartridge. As the operating slide moves forward, the fresh cartridge is carried straight along the feed-way on the bore axis and directly into the chamber.

One problem of stacking cartridges nose to tail in a magazine is that the primer of the cartridge ahead is exposed to the front of the projectile behind. The potential exists where a primer is exposed such that the trailing projectile may accidentally set off the primer ahead, especially during the jarring caused by firing of the cartridge in the chamber. Many center fire lever action rifles are designed with tubular magazines that stack the cartridges nose to tail. The nose-to-tail problem has been effectively been dealt with by providing the projectiles with flat or round noses. Additionally, the projectile tends to lie off center on the base of the cartridge ahead, not contacting the primer ahead. But if the projectile behind happens to be centered on the primer of the cartridge ahead, then the flatness or roundness of the projectile behind causes any impact of the projectile with the primer to be distributed such that the primer is not activated.

If the primer of a center fire rifle cartridge in a tubular magazine were to be activated as the result of loading the magazine with cartridges having pointed projectiles, then the affected cartridge case would rupture without generating the full cartridge pressure as when fully supported in a locked chamber. This would still be a dangerous scenario, and likely injurious but not necessarily fatal to the shooter. Grenade cartridges, however, employ High/Low propellant systems wherein full pressure is developed regardless of cartridge case support. Thus, a grenade cartridge that was accidentally fired in the magazine would develop its full normal operating pressure. Therefore the cartridge case, being substantially lighter than the projectile of the affected cartridge, would be driven rearward at high velocity into the fuse of the projectile behind. In spite of the safety devices built into grenade fuses against pre-launch detonation, it is possible the warhead of the projectile behind would be detonated. If one grenade in the magazine detonated, it would likely sympathetically detonate the rest. The most probable result to the soldier with several grenade projectiles detonating within inches of his/her head is apparent, and preferably avoided.

Referring to FIGS. 9–12 there is illustrated one form of a "vernier" feed system of the present invention wherein the cartridges are contained in a tubular magazine. Each of FIGS. 9–12 illustrates three cartridges 70. It should be understood, however, that other feed systems are contemplated as within the scope of the invention. In particular, a more preferred form of a feed system using a lifter is described in greater detail below with respect to FIGS. 13–24.

The vernier magazine round control system is designed to alleviate the potential problem of magazine detonations in grenade launchers equipped with tubular magazines. The magazine is provided with a movable "vernier" member with cartridge locators that engage the extraction rims of the cartridges. The cartridge locators are separated from each other by a distance greater than the length of the cartridge so that when the vernier member is fully rearward, each cartridge primer is separated from the projectile behind the primer. In brief, when the vernier is fully forward it is completely disengaged from the cartridges so the magazine follower can advance the stack. While not illustrated in FIGS. 9–12, means may be provided to prevent projectile-to-primer contact while advancing the stack, but this requires additional parts and added complexity. The vernier feed system is a round control mechanism that takes a shorter stack of cartridges and stretches them out on a longer scale so they don't touch each other in the magazine.

Figure 9:
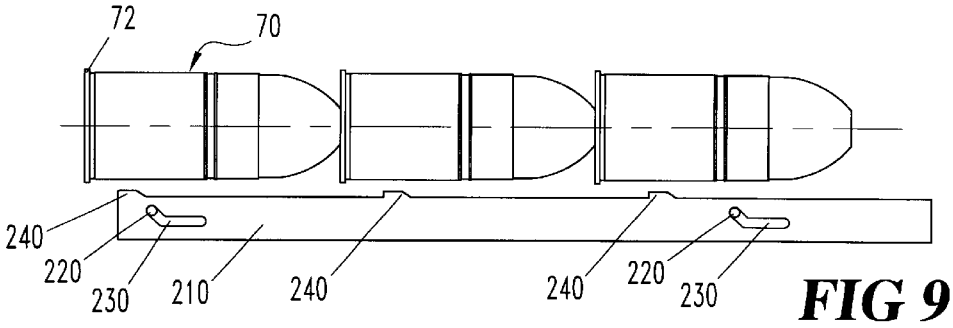
FIG. 9 is a side view of the vernier member in its fully forward position.
Figure 10:
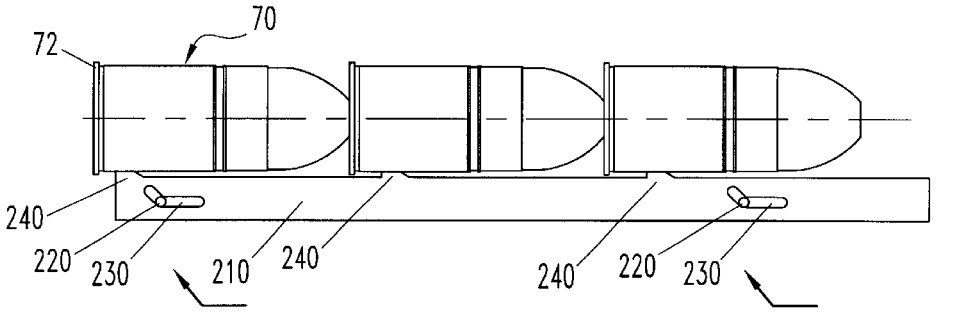
FIG. 10 is a side view of the vernier member having been moved rearward from its fully forward position of FIG. 9 so that the cartridge locators are in position against the bottom of the cartridges.

With reference to FIGS. 9–12, it should be understood that the front of the weapon from which the projectile is expelled is toward the right. Referring now to FIG. 9, vernier member 210 is in its fully forward position being positioned on pins 220 carrying vernier 210 in slots 230. With vernier 210 in this position, cartridge locators 240 are disengaged from the cartridges 70. The magazine follower (not illustrated) has pushed the cartridge column fully forward. With reference to FIG. 10 vernier 210 has been moved rearward (by means not illustrated), and therefor upward riding on pins 220. Cartridge locators 240 are in position against the bottoms of the cartridges 70 but not in contact with the cartridge rims 72.

Figure 11:
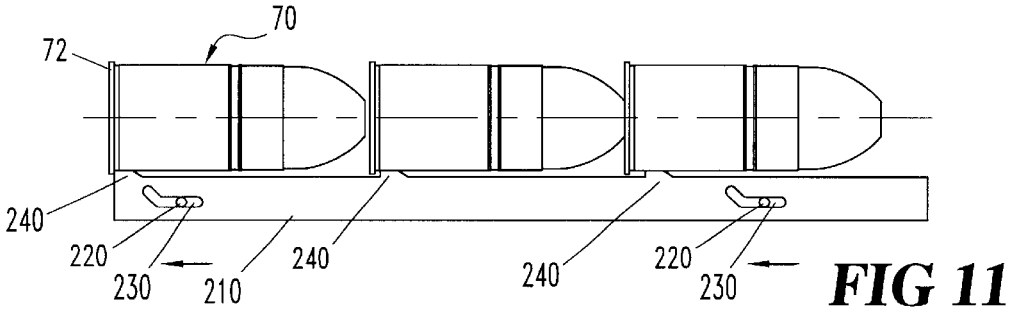
FIG. 11 is a side view of the vernier member having been moved sufficiently rearward for the rear cartridge locator to have contacted the extraction rim of the rear cartridge.
Figure 12:
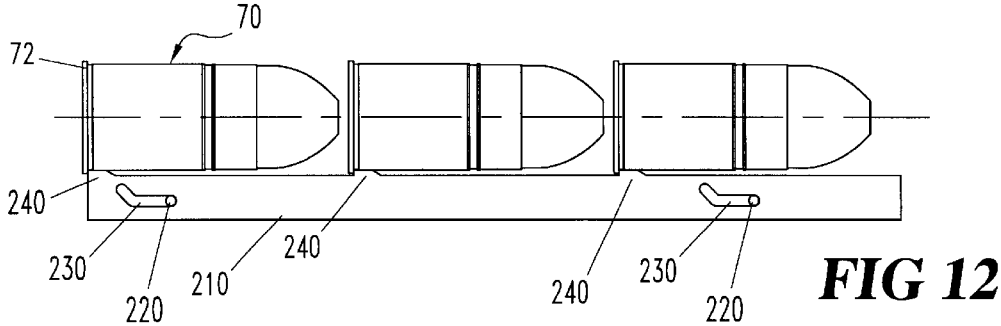
FIG. 12 is a side view of the vernier member moved fully to the rear.

Referring now to FIG. 11, vernier 210 has been moved sufficiently rearward for rear cartridge locator 240 to have contacted the extraction rim 72 of the rear cartridge 70. The rear cartridge 70 is being moved toward the rear. The other two cartridge locators 240 have not yet engaged with their respective cartridge rims 72. With reference to FIG. 12, vernier 210 has been moved fully to the rear. All cartridge locators 240 have contacted their respective cartridge case extraction rims 72. All cartridges 70 have been separated from each other. It should be understood that the mechanism involved may be designed to locate more or fewer cartridges as preferred.

The feed system described below and illustrated in FIGS. 13–24 includes a lifter. The lifter feed system is the preferred embodiment because the lifter is simpler, eliminates the possibility of contact of primers with projectiles and permits much greater magazine capacities for the same length of magazine or equal magazine capacity for a smaller length magazine. This may be accomplished using a means for transferring perpendicularly disposed cartridges out of a magazine and into alignment with the weapon chamber. It should be understood that offset angles other than perpendicular are contemplated as within the scope of the invention. By employing positive round control the feed mechanism prevents all projectiles in the magazine and feed system from contacting each other while in the weapon. Except for the possibility of light contact with cartridge locators during part of the recoil phase of the operating cycle, the mechanism preferably prevents all projectiles from contact with any interior part of the weapon until the cartridge being chambered is aligned with the axis of the weapon bore. From this point the cartridge is moved linearly forward into the chamber without requiring ramping.

In one form of the present invention, the mechanism preferably includes a buffer that cushions the cartridges in the magazine and in the feed system against the jarring of the weapon caused by firing. Additionally, it is preferable that at no time while the cartridge is within the weapon is the cartridge a free body depending upon its own momentum or any funneling effect or ramping to direct the movement of the cartridge. Even at ejection the empty cartridge case is physically displaced clear of the weapon. Therefore, whether the weapon mechanism is cycled as in normal firing or if the weapon is slowly manually cycled, then all round control functions are positively accomplished without ever depending upon the momentum of the cartridge or empty cartridge case.

The weapon is preferably provided with an on-board magazine that is single loaded or loaded from low cost, lightweight stripper clips known to those of ordinary skill in the art and used with numerous service rifles since late in the 19th century. Stripper clips for the grenade launcher may be designed to hold any required number of cartridges. It is expected that a capacity of three to five rounds will prove to be optimal for grenade launcher stripper clips, depending upon the diameter of the cartridges being used, and upon the magazine capacity of the grenade launcher. It should be understood that other capacity magazines are contemplated as within the scope of the invention. Several strippers clips could be used to load the magazine. Stripper clips for the present invention are preferably inexpensive, of no use to the enemy, and may be made of biodegradable material intended to be discarded after use.

Since the weapon has an on-board magazine, there are no extra magazines with their duplication of springs, followers and magazine bodies that would otherwise be required for each magazine load of ammunition. This eliminates added bulk and weight from the soldier's load. The on-board magazine may also be "topped off" with single rounds, or from stripper clips. Topping off is accomplished without opening the operating mechanism or unloading the weapon. Thus the weapon may be kept ready to fire at all times. Loose single rounds and/or loaded stripper clips may be carried in a shoulder bag as currently carried by the grenadier for ready ammunition.

The on-board magazine in a weapon employing the preferred embodiment stores the cartridges in a row behind the feed mechanism with the projectiles pointing substantially upward and with the stack of cartridges extending toward the rear through the full length of the butt stock. This magazine arrangement results in the weapon having a side profile similar to that of the typical service rifle, except that the grenade launcher does not have a magazine protruding below the weapon. When slung on the back or shoulder for carrying, this magazine arrangement permits the weapon to rest against the soldier's body in the same manner as a conventional service rifle with no bulging magazine to press against the soldier. The on-board magazine is preferably loaded from the rear by opening the magazine door in the butt plate and then inserting single cartridges, or by placing a loaded stripper clip into its slot and sliding the rounds out of the stripper clip and into the magazine. The stripper clip may then be discarded and the magazine door closed. Loading through the rear of the weapon permits the soldier to maintain a low prone position while loading or reloading.

Referring to FIGS. 13–24, there is illustrated a cartridge feed system. The cartridge feed system of FIGS. 13–24 may transfer cartridges from the perpendicular or otherwise offset plane of a magazine to the horizontal plane of the barrel axis of a firearm. The cartridge feed system of FIGS. 13–24 preferably isolates projectiles from damage caused by contact with the firearm, or by contact with other cartridges in the firearm.

Figure 13:
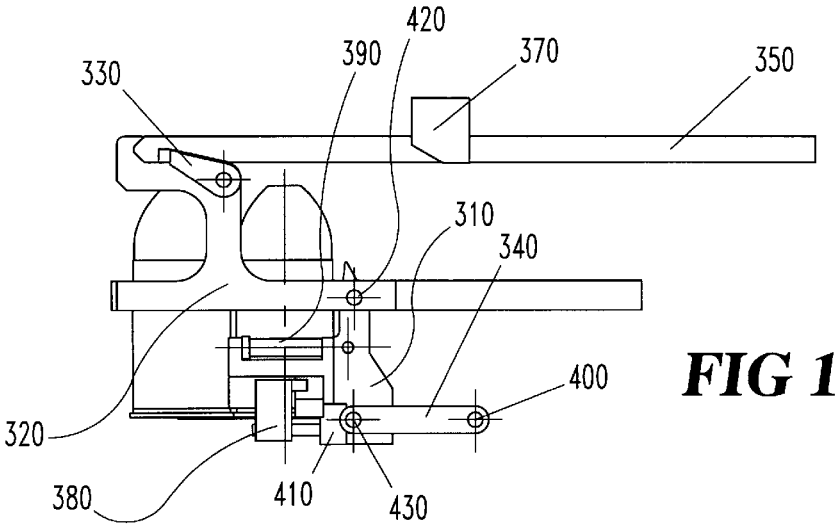
FIG. 13 is a side view of the feed system with the operating slide fully rearward.

With reference to FIGS. 13–24, it should be understood that springs and various other elements not required for understanding the invention are not illustrated. Referring to FIG. 13, operating slide 350 is in its fully rearward position with drive pawl 330 positioned ready to be picked up by recess 351 of operating slide 350 as it moves forward. Lifter 360 (not visible in FIG. 13 but illustrated in FIGS. 20 and 21) has a notch 361 that is engaged with the cartridge extraction rim 362. Carrier drive 320, cartridge carrier 310 and carrier link 340 couple with link pin 430 as a functional unit. Carrier drive 320 is pivotally connected to cartridge carrier 310 by carrier pin 420. Cartridge carrier 310 is pivotally connected to carrier link 340 by link pin 430. Carrier link 340 pivots about stationary link pivot 400.

Figure 14:
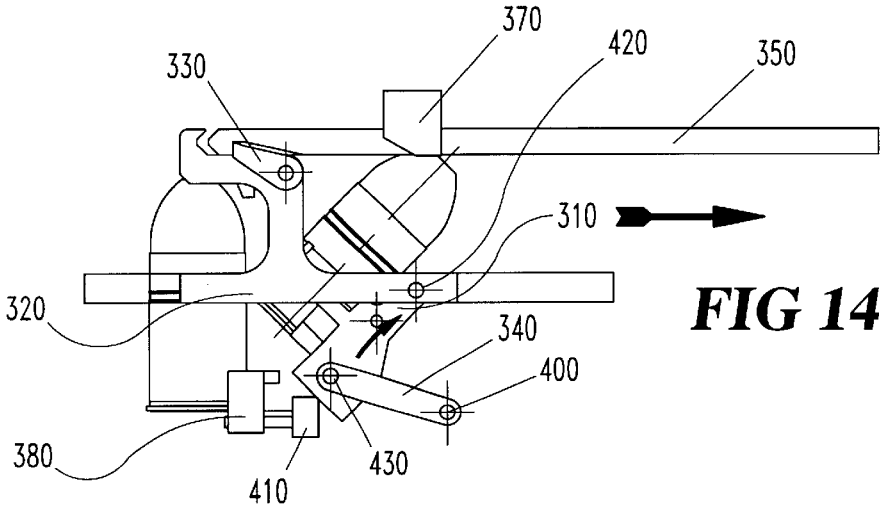
FIG. 14 is a side view of the feed system with the operating slide beginning forward and rotating the cartridge carrier toward alignment with the barrel axis.
Figure 20A:
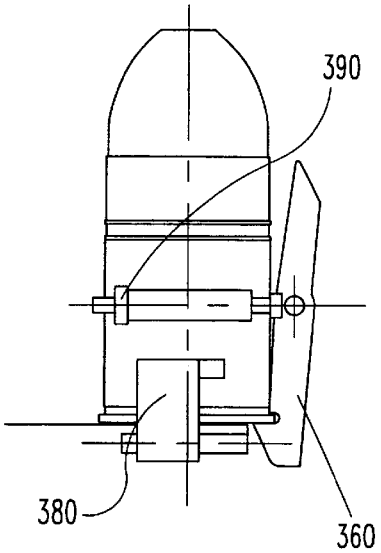
FIG. 20A is a side view of selected parts with the carrier in its initial position.
Figure 20B:
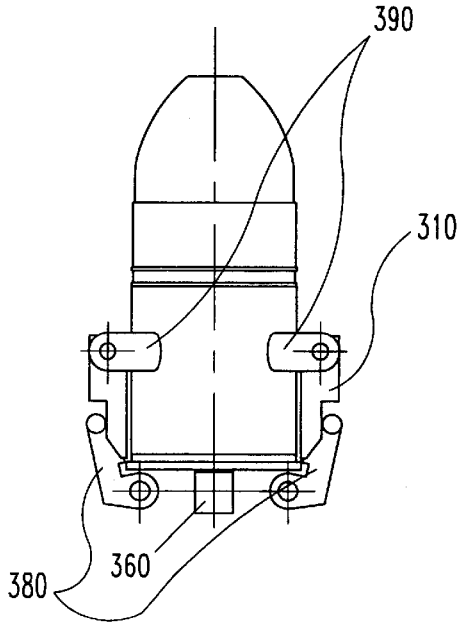
FIGS. 20B and 20C are the same as FIG. 20A but illustrated in rear and top views.
Figure 23A:
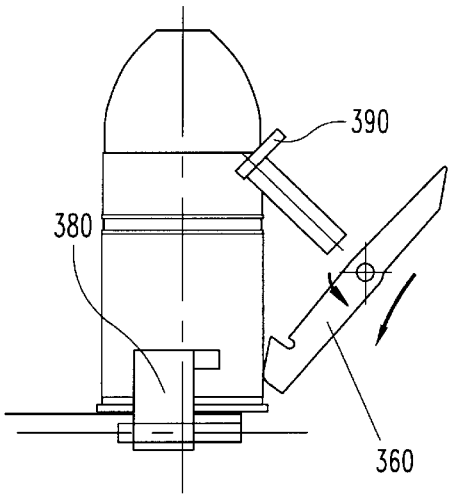
FIGS. 23A–C are side, rear and top views illustrating the function of selected parts during the recoil stroke of the mechanism.
Figure 23B:
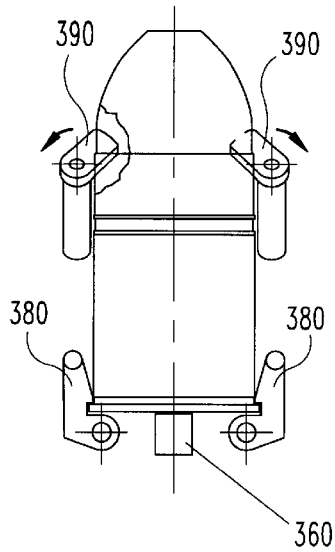

As is more clearly illustrated in FIG. 20B, the cartridge controllers 380 (also illustrated in FIGS. 20 and 21) are cammed out of engagement with the cartridge by cartridge carrier 310. Cartridge locators 390 (more clearly illustrated in FIGS. 20 and 21) are retaining the cartridge within cartridge carrier 310. Referring now to FIG. 14, operating slide 350 is moving forward carrying drive pawl 330 and carrier drive 320 forward. Cartridge carrier 310 is travelling in an arc as illustrated. Lifter 360, while not visible in FIGS. 13 and 14 is lifting the cartridge as illustrated in FIG. 21. Cartridge controllers 380 have returned to their initial position as illustrated in FIG. 23B.

Figure 15:
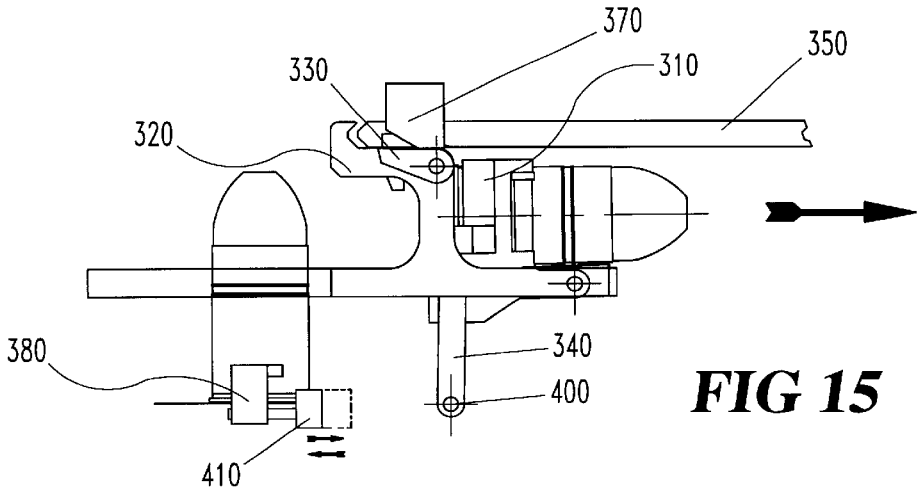
FIG. 15 is a side view of the feed system with the feed slide continuing forward having rotated the cartridge carrier with its cartridge into alignment with the bore axis.
Figure 16:
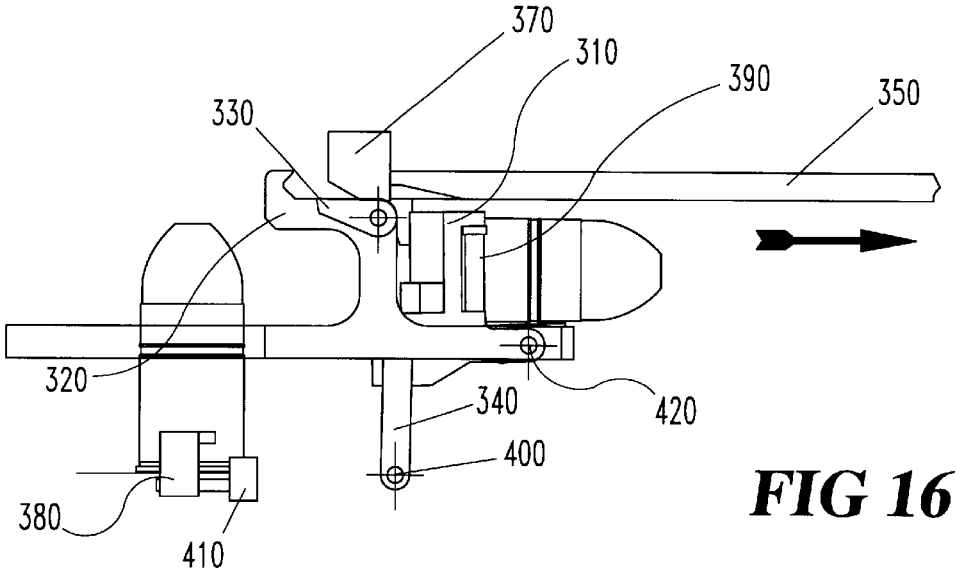
FIG. 16 is a side view of the feed system having stopped rotating, having completed its work in feeding with the operating slide disengaged from the cartridge carrier and with the operating slide continuing to move forward to chamber the cartridge.
Figure 17:
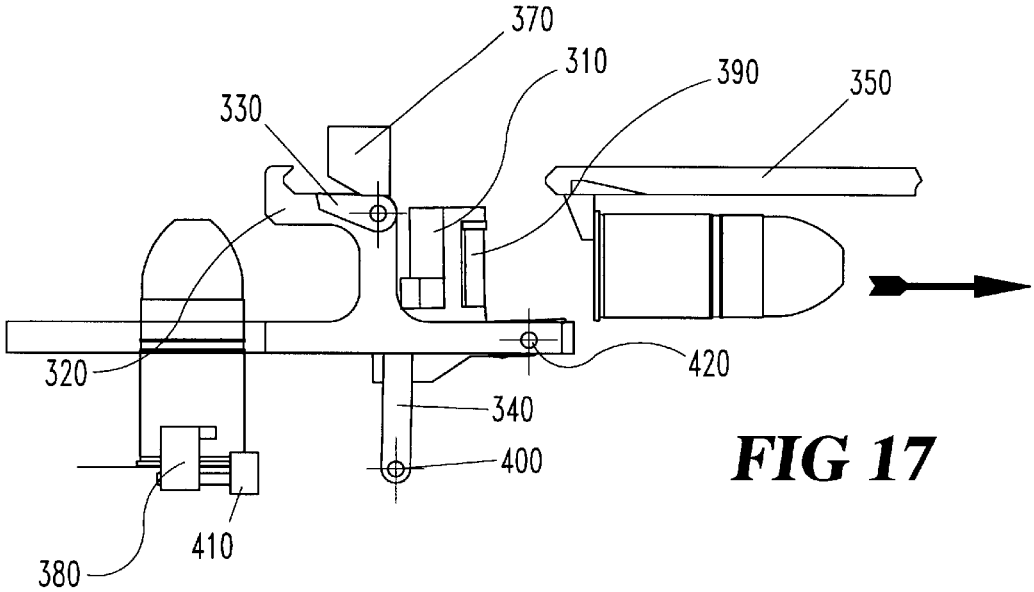
FIG. 17 is a side view of the feed system remaining stopped, with the operating slide continuing to move forward in chambering the cartridge.

With reference to FIG. 15, operating slide 350 has moved sufficiently forward to have caused cartridge carrier 310 to have rotated the axis of the cartridge onto the axis of the weapon bore. Drive pawl 330 has been cammed out of engagement with operating slide 350 by stationary cam 370, thereby releasing cartridge carrier 310 from being rotated further. With the first cartridge having been removed from the magazine, the next cartridge in the magazine moves forward into engagement with cartridge controllers 380. (See FIG. 23B for the positions of cartridge controllers 380). The magazine follower and spring (not illustrated) have moved the stack of cartridges forward so the front cartridge in the magazine has struck the cartridge stops 410. Cartridge stops 410 are spring loaded to serve as buffers to arrest the forward moving cartridges in the magazine. The spring loaded cartridge stops 410 also serve as buffers to cushion the cartridge stack from the recoil of firing. Isolating the cartridge stack from recoil also serves to maintain more uniform operating mechanism mounting resistance from shot to shot regardless of how many rounds remain in the magazine. Uniform mounting resistance improves functional reliability and contributes to better weapon accuracy. As illustrated in FIGS. 16 and 17, operating slide 350, having disengaged from carrier drive 320 continues to transport the cartridge toward the chamber.

Figure 18:
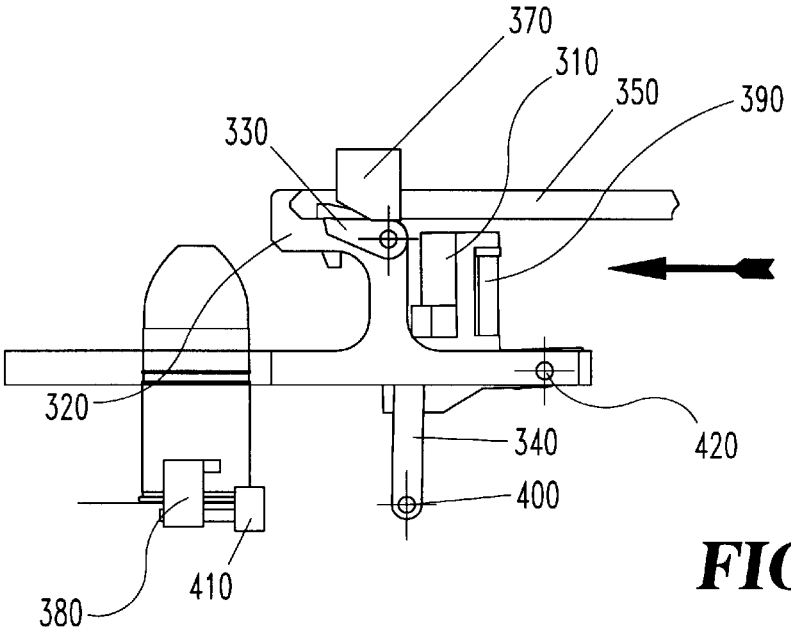
FIG. 18 is a side view of the operating slide moving rearward after firing and coming into contact with the cartridge carrier.
Figure 19:
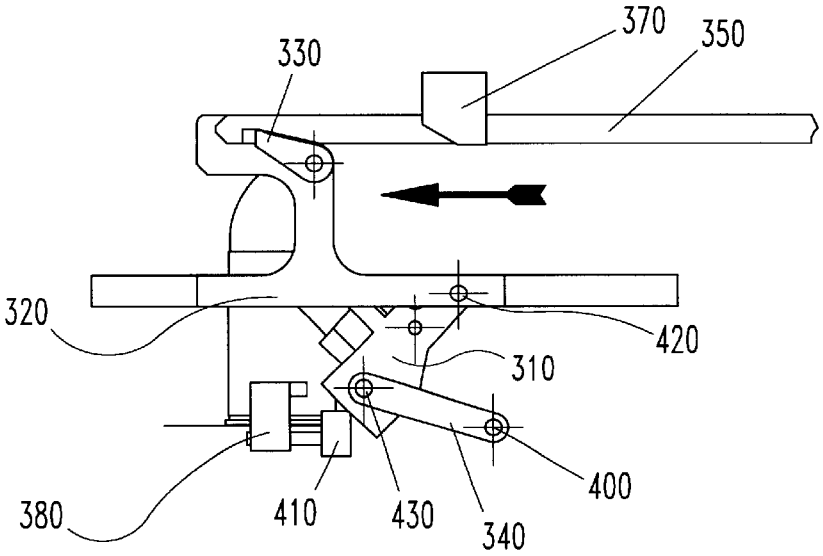
FIG. 19 is a side view of the operating slide continuing toward its rearward position returning the cartridge carrier toward its initial position.
Figure 21C:
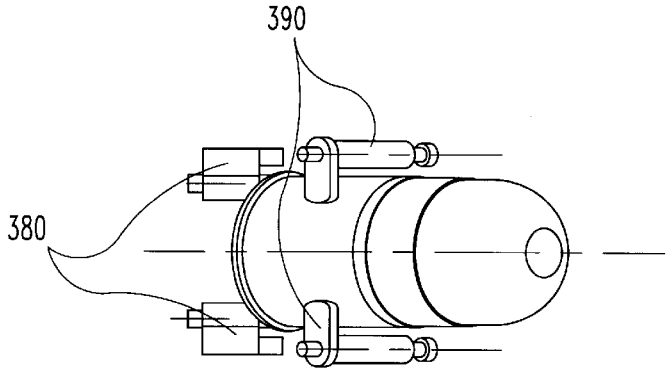
FIGS. 21A–C are the same as FIGS. 20A–C except the cartridge has been rotated approximately 45 degrees toward the fully fed position.
Figure 21B:
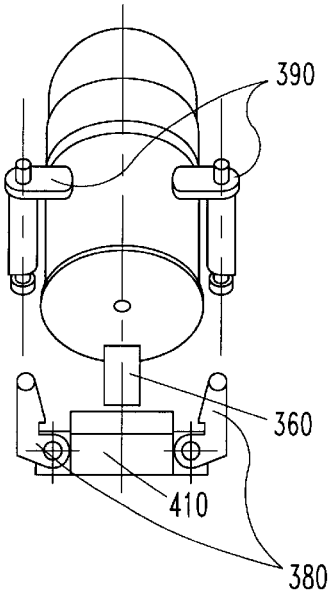
Figure 21A:
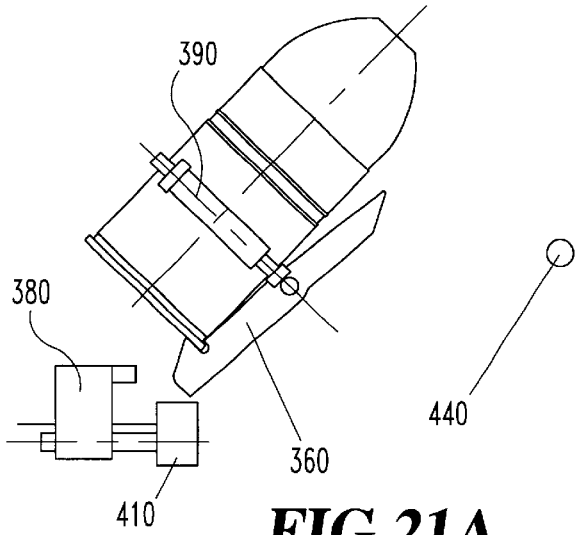
Figure 23C:
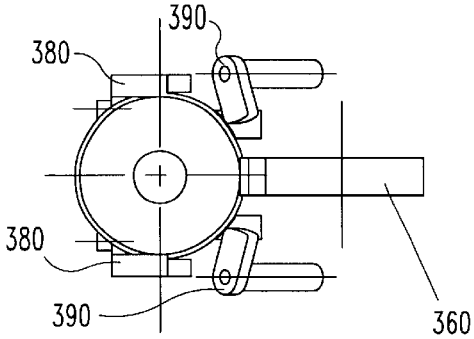

Referring now to FIG. 18, the weapon has been fired and operating slide 350 is moving rearward in its recoil stroke of the operating cycle. Operating slide 350 has contacted receptacle 321 of carrier drive 320 and carrier drive 320 is beginning to move rearward. The front cartridge in the magazine is securely positioned by cartridge controllers 380 (as illustrated in FIGS. 23A–C) and cartridge stops 410 and by the magazine follower or next round (not illustrated). As illustrated in FIG. 19, operating slide 350 continues its rearward stroke, rotating cartridge carrier 310 toward its initial position as illustrated in FIG. 13. Drive pawl 330 has rotated into its initial position, thus when operating slide 350 begins its forward movement, carrier drive 320 will also move forward as in FIG. 14. Cartridge locators 390, not illustrated in FIG. 19 (but illustrated in FIGS. 23A–C) have contacted the cartridge and are being rotated by contact with the cartridge in preparation for moving into their place to secure the cartridge as illustrated in FIGS. 21A–C.

Figure 20C:
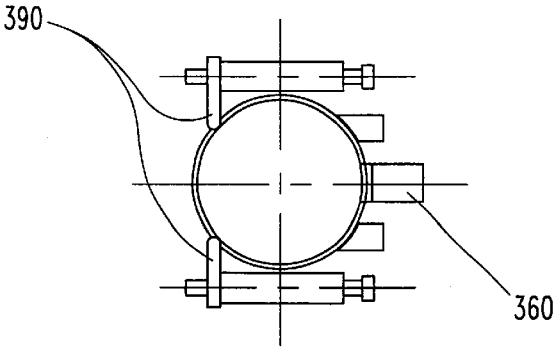

Referring now to FIG. 20, selected parts are illustrated in side, rear and top views with the cartridge carrier (not illustrated in FIG. 20) positioned as in FIG. 13. Cartridge locators 390 secure the cartridge from moving to the rear as illustrated in FIG. 20A. As best illustrated in FIG. 20B, the lower projections of cartridge carrier 310 have cammed cartridge controllers 380 out of engagement with the cartridge. FIGS. 21 A–C are similar to FIGS. 20A–C except that the cartridge carrier (not illustrated) has rotated the cartridge approximately 45 degrees toward the fed position illustrated in FIG. 14. Cartridge locators 390 and lifter 360 secure the cartridge within the cartridge carrier (not illustrated) so that the cartridge will be positively transported into alignment with the weapon bore axis for chambering. Cartridge controllers 380 have returned to their initial position, ready to secure the next cartridge the magazine presents.

Figure 22B:
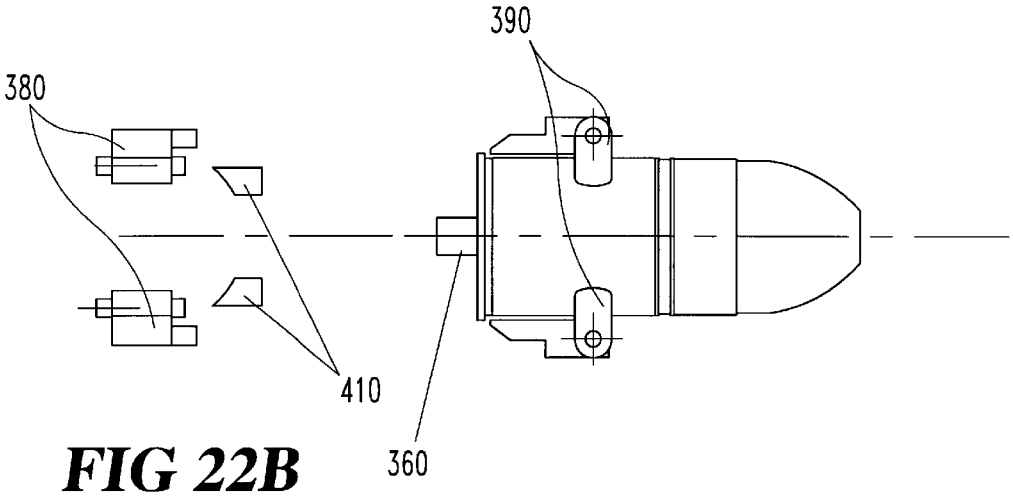
FIGS. 22A and 22B illustrate the same parts as FIGS. 21A and 21C with the cartridge rotated to its fully fed position.
Figure 22A:
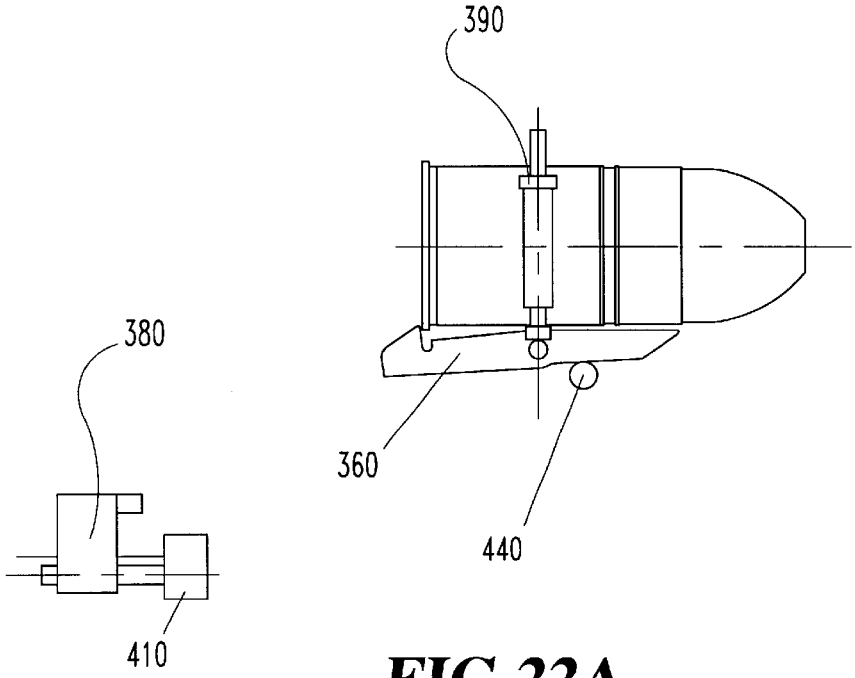

FIG. 22 illustrates various components in the same position illustrated in FIG. 15, except that certain components have been removed to more clearly illustrate the function of lifter 360. The cartridge carrier (not illustrated) has rotated the cartridge to the fully fed position. The front of lifter 360 has contacted stationary lifter cam 440. Lifter cam 440 has rotated the front of lifter 360 upward and the rear downward. Rotating the rear of lifter 360 downward has disengaged notch 361 of lifter 360 from the extraction rim 362 of the cartridge. The cartridge is now free to be transported into the chamber by the rammer (not illustrated). Cartridge locators 390 will be rotated away from the extraction rim of the cartridge by passage of the cartridge extraction rim through cartridge locators 390. After passage of the extraction rim, cartridge locators 390 will return to their positions illustrated in FIGS. 20 and 21. FIG. 23 illustrates various components at the same point in the cycle during which the cartridge carrier (not illustrated) is returning toward its initial position as illustrated in FIG. 19. Cartridge locators 390 are riding out over the ogive of the front cartridge in the magazine. Lifter 360 is being rotated by contact with the cartridge. When the cartridge carrier (not illustrated) returns to the position illustrated in FIG. 13, cartridge locators 390 and notch 361 of lifter 360 will engage the extraction rim of the front cartridge in the magazine as illustrated in FIG. 20 and cartridge controllers 380 will have been disengaged as illustrated in FIG. 20B.

Figure 24A:
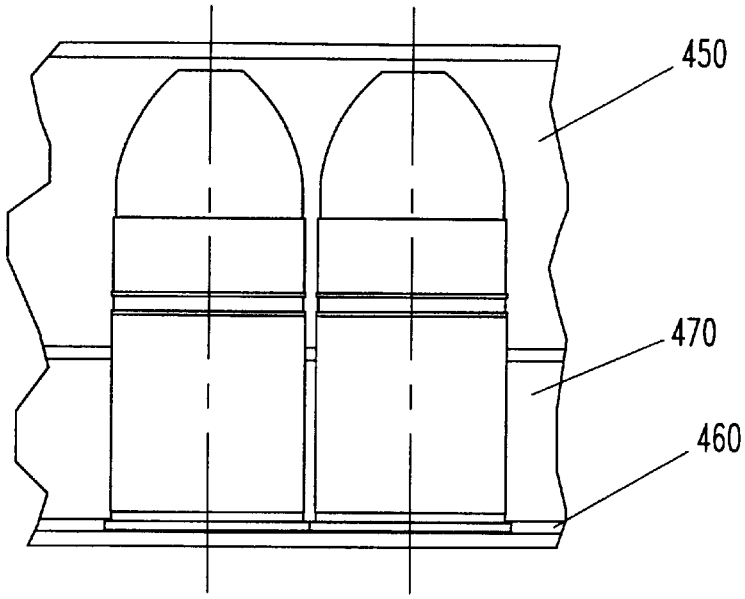
FIGS. 24A and 24B are side and rear views illustrating how the projectiles are isolated from each other and from the weapon magazine.
Figure 24B:
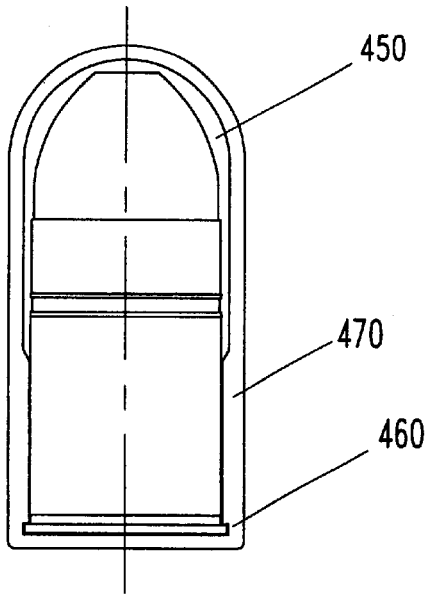

With reference to FIGS. 24A–B there are illustrated various aspects of the retention of a cartridge within the magazine housing. The lower part of the cartridge is guided by the narrow portion of magazine housing 470 and by cartridge guide slot 460 that prevents the cartridges from tipping and preventing the projectiles from touching each other. The rim of the cartridge is guided by cartridge guide slot 460 engaged with the extraction rim of the cartridge. The gap between the projectile and magazine housing 450 is maintained because cartridge guide slot 460 is engaged with the extraction rim of the cartridge preventing the cartridge from moving upward.

With reference to FIGS. 25–31 there is illustrated a dwell preferably utilized with the operating system of FIGS. 1–8 for optimal functioning of the operating system. In order for the levers of the operating system to return to battery (closed) position without clashing, it is preferable to briefly retard the breech lever after it has applied power to the accelerator lever during opening. Retarding the breech lever after the power impulse of firing causes the accelerator lever to move away from the breech lever during opening. Using a dwell to retard the breech lever is not required on the opening stroke, but on the closing stroke the clearance produced by the dwell is preferred to insure the breech lever moves ahead of the accelerator lever in the same manner as rotating spur gear teeth smoothly mesh. Without the dwell the breech lever and accelerator lever may clash when closing in the same manner as clashing spur gear teeth.

Figure 25:
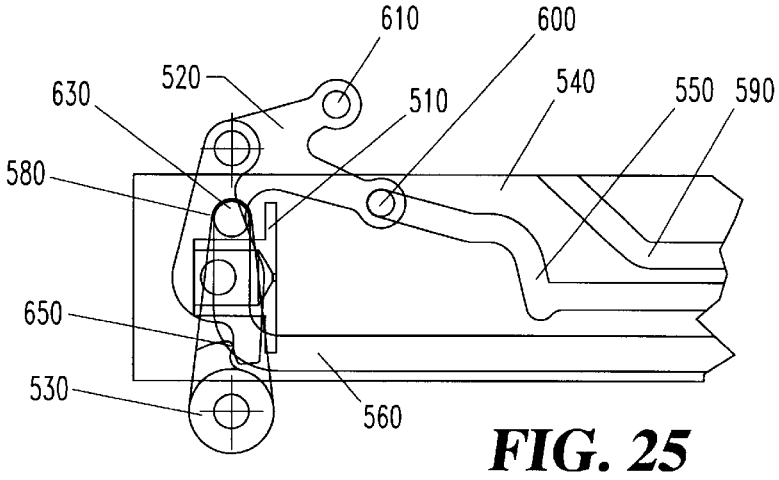
FIG. 25 is a plan view of one aspect of the operating system prior to and at the instant of firing.

Referring now to FIG. 25 The cartridge case (not illustrated) of a cartridge (not illustrated) being fired is pressing against breech pad 510. Breech pad 510 is mounted on breech lever 520. Breech lever 520 is in contact with accelerator lever 530 at contact point 650. Drive lug 630 of accelerator lever 530 is in contact with operating slide 540 at contact point 580 (contact point 580 is more clearly illustrated in FIG. 26 and most clearly illustrated in FIG. 27) in the upper portion of cam groove 560. Positioning lug 600 in groove 550 is subject to no forces at this time, instead positioning lug 600 is merely riding in groove 550. At no time during the operating cycle are positioning lugs 600 and 610 or grooves 550 and 590 subject to any more force than is required to properly position breech lever 520 against its own inertia. Positioning lugs 600 and 610 are timed with grooves 550 and 590 for neutral contact until dwell 620 illustrated in FIG. 27 is reached.

Figure 26:
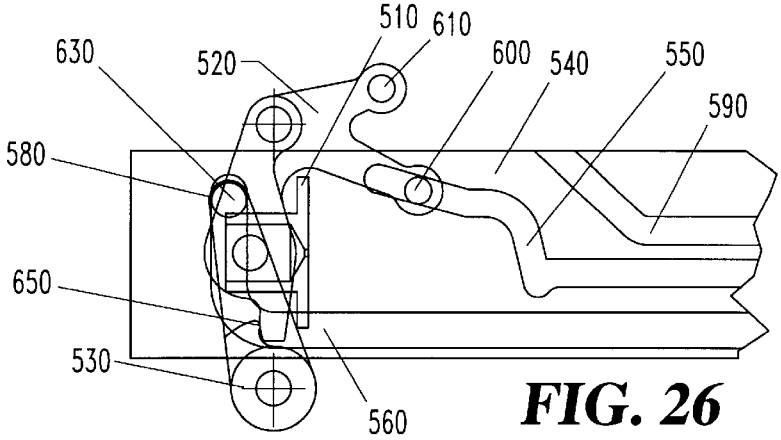
FIG. 26 is a plan view of FIG. 25 at the time in the cycle in which the accelerator lever is transmitting force through the accelerator lever to the operating slide.

The forces of firing are transmitted from breech pad 510 into breech lever 520 that transmits the recoil force at contact point 650 to accelerator lever 530 and through drive lug 630 of accelerator lever 530 to operating slide 540 at contact point 580. Referring to FIG. 26, the cartridge case (not illustrated) is continuing to drive breech pad 510 rearward which in turn causes breech lever 520 to pivot on its axis. Breech lever 520 contacts accelerator lever 530 at contact point 650 and forces accelerator lever 530 to rotate. Drive lug 630 of accelerator lever 530 is in contact with and driving operating slide 540 at contact point 580. The mechanical disadvantage provided by breech lever 520 and accelerator lever 530 causes operating slide 540 to move at several times the speed of breech pad 510, thus retarding the opening of breech pad 510. This retardation is described above with respect to FIGS. 1–8.

Figure 27:
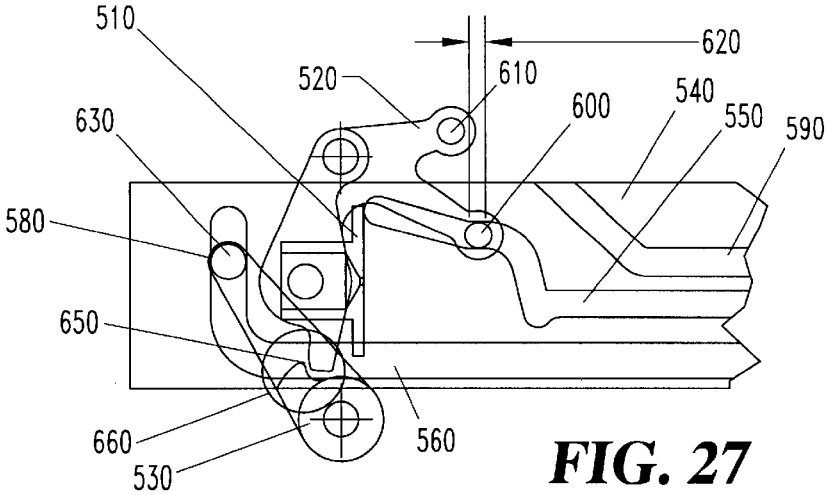
FIG. 27 is a plan view of FIG. 25 at the time in the cycle in which the dwell is retarding the breech lever but the accelerator lever is continuing to rotate.
Figure 28:
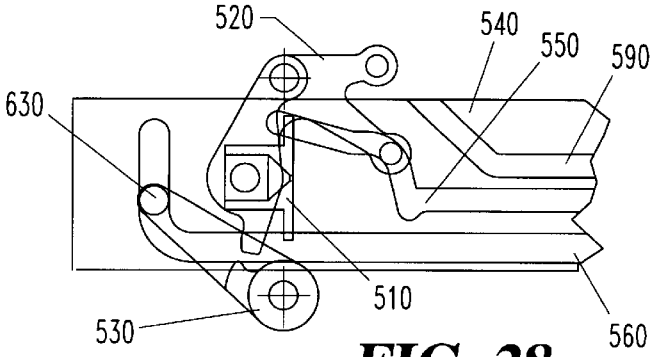
FIG. 28 is a plan view of FIG. 25 at the time in the cycle in which the operating slide continues rearward and rotates the breech lever and accelerator lever away from the axis of the bore.
Figure 29:
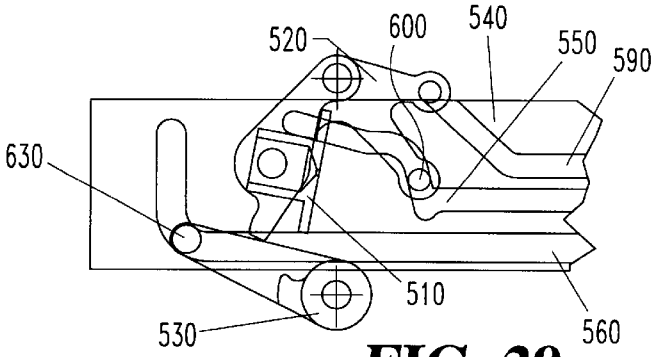
FIG. 29 is a plan view of FIG. 25 at the time in the cycle later than that of FIG. 28 in which the operating slide continues rearward and rotates the breech lever and accelerator lever further away from the axis of the bore.
Figure 30:
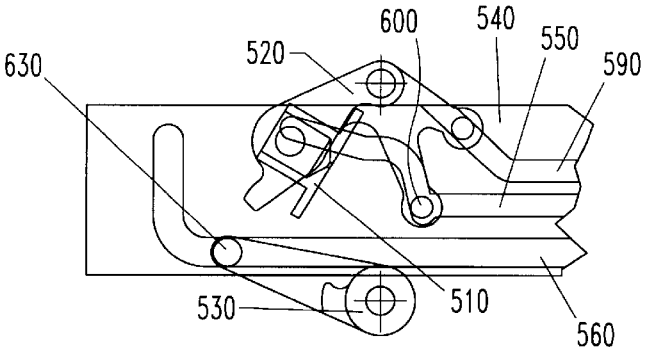
FIG. 30 is a plan view of FIG. 25 at the time in the cycle later than that of FIG. 29 in which the operating slide continues rearward and continues to rotate the breech lever away from the axis of the bore.

Referring now to FIG. 27 in which the pressure in the firing chamber has subsided to zero after the projectile has exited the muzzle. Operating slide 540 continues rearward of its own momentum that was imparted by firing. At this time operating slide 540 no longer provides resistance against opening of the mechanism, but instead operating slide 540 now provides the energy for opening the mechanism. Positioning lug 600 has entered the horizontally straight portion, or dwell 620, of groove 550. While positioning lug 600 is in dwell portion 620 of groove 550 of operating slide 540, breech lever 520 does not rotate because dwell portion 620 of groove 550 is parallel to the direction of travel of slide 540. It should be understood that a complete halt of the rotation of breech lever 520 is not required, instead a slowing of the rotation of breech lever 520 will be sufficient to generate a separation that permits the breech lever 520 to close ahead of the accelerator lever 530. But since drive lug 630 of accelerator lever 530 is in contact with operating slide 540 at contact point 580 in the vertical portion of groove 560, accelerator lever 530 continues to rotate while breech lever 520 does not rotate. This permits breech lever 520 and accelerator lever 530 to separate from each other at contact point 650 resulting in clearance 660. While this clearance is not required at opening of the mechanism, clearance is preferred at closing to permit breech lever 520 to close ahead of accelerator lever 530. Without clearance between breech lever 520 and accelerator lever 530 at contact point 650 there may be clashing between breech lever 520 and accelerator lever 530 instead of the smooth meshing at contact point 650 during closing.

Figure 31:
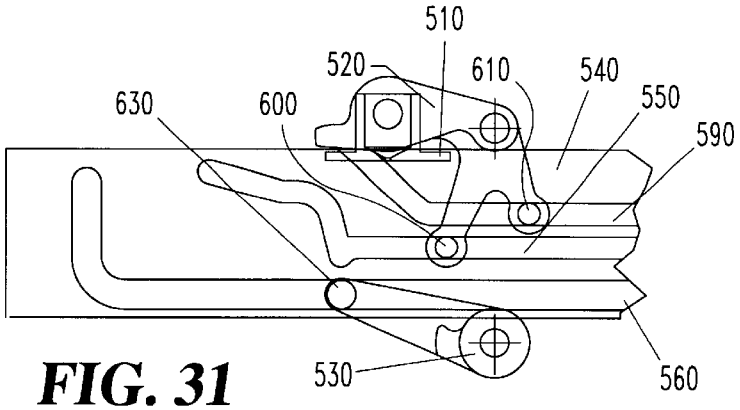
FIG. 31 is a plan view of FIG. 25 at the time in the cycle later than that of FIG. 30 in which the breech lever and accelerator lever have been rotated completely away from the axis of the bore.

Referring to FIGS. 28–31, operating slide 540 continues rearward. Positioning lug 600 riding in groove 550 rotates breech lever 520 completely away from the axis of the bore as illustrated in FIG. 31. Accelerator lever 530 is also rotating away from the axis of the bore as illustrated in FIG. 31 by drive lug 630 riding in groove 560 of operating slide 540. Positioning 610 lug enters groove 590 in FIG. 29. The empty cartridge (not illustrated) will be ejected as operating slide 540 moves rearward, and the rammer (not illustrated) attached to operating slide 540 will engage a fresh cartridge that will be carried forward and into the chamber on the closing stroke. The grooves and levers will cause breech pad 510 to close behind the cartridge (not illustrated) in preparation for firing.

It should be understood that alternative forms of the recoil transmitting mechanism are contemplated as within the scope of the invention. For example, the form illustrated in FIGS. 1–8 and FIGS. 25–31 includes two levers, a breech lever and an accelerator lever. While the use of a breech lever and an accelerator lever is preferred for chambering grenade cartridges, it should be understood that the use of a single lever design, while less preferred, is contemplated as within the scope of the invention.

Figure 32:
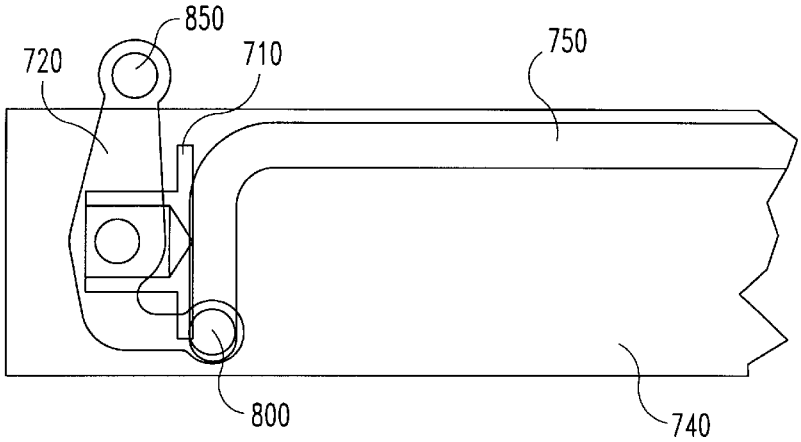
FIG. 32 is a plan view of one aspect of the operating system prior to and at the instant of firing.
Figure 33:
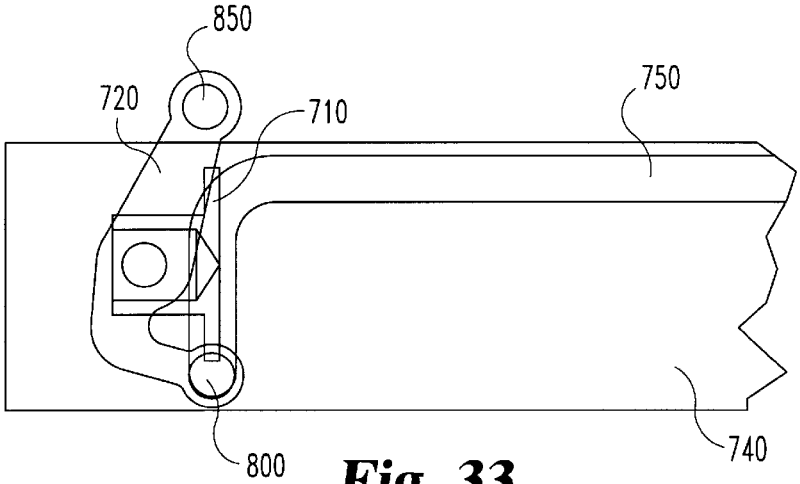
FIG. 33 is a plan view of FIG. 31 at the time in the cycle in which the breech lever is transmitting force to the operating slide.
Figure 34:
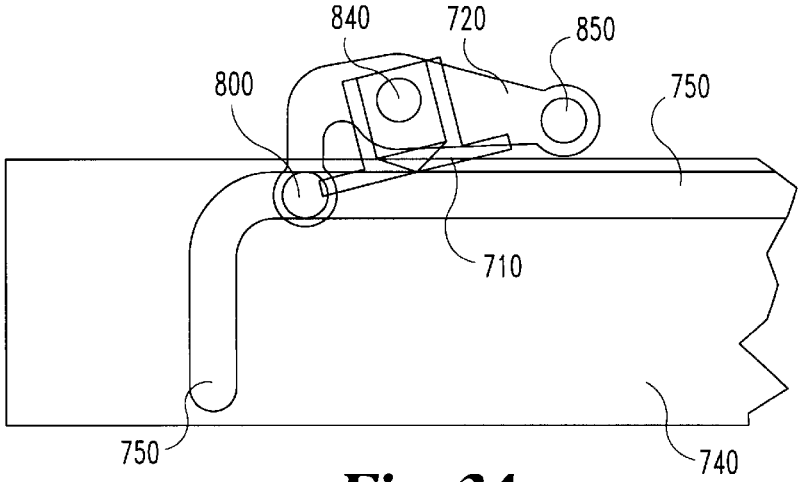
FIG. 34 is a plan view of FIG. 31 at the time in the cycle in which the operating slide continues rearward and rotates the breech lever away from the axis of the bore.

Referring now to FIGS. 32–34 there is illustrated a form of the invention utilizing a single lever. A cartridge (not illustrated) is supported in the chamber of the barrel by breech pad 710. Breech pad 710 is mounted to breech lever 720 by breech pad pivot 840. Breech lever 720 is mounted to the receiver by breech lever pivot 850. The breech lever includes a lug 800. Drive lug 800 of breech lever 720 is in contact with operating slide 740 within the cam groove 750. Operating slide 740 is in its battery position and resting against the breech lever lug 800. It is contemplated that operating slide 740 for a 40 mm grenade launcher may have a weight similar to a bolt carrier or operating rod of a typical military service rifle.

Referring now to FIG. 33, the cartridge has been fired by a conventional firing mechanism (not illustrated). A projectile (not illustrated) is being driven forward by the propellant gas, and the empty cartridge case (not illustrated) is being driven rearward. The recoil force of firing is being applied by the base of the cartridge case to breech pad 710 through breech pad pivot 840 to breech lever 720, through bearing lug 800, to operating slide 740. The breech pad 710 rotates on breech pad pivot 840 to maintain the face of breech pad 710 flat against the base of the cartridge case as breech lever 720 rotates. Breech pad 710 transmits the recoil force to breech lever 720. The force applied at breech pad pivot 840 applies work to operating slide 740 through drive lug 800.

Referring now to FIG. 34, operating slide 740 continues rearward of its own momentum that was imparted by firing. At this time operating slide 740 no longer provides resistance against opening of the mechanism, but instead operating slide 740 now provides the energy for opening the mechanism. Breech lever drive lug 800 has entered a horizontally straight portion of groove 750. While lug 800 is in the horizontally straight portion of groove 750 of operating slide 740, breech lever 720 does not rotate because the straight portion of groove 750 is parallel to the direction of travel of slide 740.

In designing a weapon utilizing various aspects or the entirety of the present invention the bolt assembly mass need not dictate the design. Instead, the design is driven by weapon cycling requirements since there is no bolt in the operating system of grenade launcher 1. The operating slide must receive and store only enough energy for moving the parts through the steps in the functioning cycle of the weapon. The magazine follower spring provides some of the energy for chambering the cartridge. Since the breech is not strictly locked, and because gas pressure against the inside of the cartridge case initiates extraction, very little energy is required to complete extraction of the fired cartridge. Also, since the breech lever and accelerator lever are already rotating toward their fully open positions as a result of firing, very little energy is therefore required of the operating slide to fully open the breech lever and accelerator lever. Ejection of the empty cartridge case requires only a minimal amount of energy in order to move the empty cartridge off-axis and out of the weapon.

Chambering the cartridge requires the greatest amount of energy. A low velocity 40 mm grenade cartridge weighs about 0.5 pounds and, in one form of the present invention, preferably requires transfer linearly forward into the chamber. The force of the magazine follower spring is of direct assistance in chambering, rather than being a friction hindrance as previously discussed with respect to conventional box magazines. If the muzzle is elevated while firing, the low mass of the recoiling parts relative to the force of the drive spring cycles the weapon more reliably than if a conventional bolt/bolt carrier were used because the recoiling parts of the invention are much lighter than in conventional systems.

While the invention has been illustrated and described in detail in the drawings and foregoing description, the same is to be considered as illustrative and not restrictive in character, it being understood that only the preferred embodiment has been illustrated and described and that all changes and modifications that come within the spirit of the invention are desired to be protected. For example, although reference has been made herein to grenade cartridges, the invention is suitable for use with other types of cartridges, such as tear gas cartridges, smoke cartridges, shotgun cartridges, and the like. In reading the claims it is intended that when words such as "a", "an", "at least one", "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A firearm for firing a cartridge, comprising:

a magazine having a rearward end and a forward end, the magazine having a receptacle holding one or more cartridges therein;

a barrel having a rearward end and a forward end, the barrel having a bore with a center bore axis extending therethrough;

a receiver having a cavity extending therethrough in communication with the magazine receptacle and the barrel bore such that the bore axis extends through the cavity, the cavity further having a chamber portion adjacent a rearward end of the barrel bore to hold one of the cartridges in a firing position, the receiver including a weapon operating system having:

a slide extending substantially parallel with the bore axis adjacent to the receiver cavity;

a recoil transmitting mechanism coupled to the receiver and in contact with the slide, the recoil transmitting mechanism in communication with the cartridge when the cartridge is in the firing position; and a trigger assembly operable to fire a chambered cartridge, wherein the fired cartridge causes the recoil transmitting mechanism to displace the slide rearwardly; and, wherein the recoil transmitting mechanism includes:

a breech lever in contact with the cartridge, the breech lever pivotally coupled to the receiver at a first location remote from the contact with the cartridge, the breech lever further including a breech lug engaging the slide when the cartridge is in the firing position; and an accelerator lever in contact with the breech lever and pivotally coupled to the receiver at a second location and in contact with the breech lever, the accelerator lever including an accelerator lug engaging the slide when the cartridge is in the firing position.

2. The firearm of claim 1, wherein the slide includes a breech lever cam path and an accelerator cam path, the breech lug positioned in the breech cam lever path and the accelerator lug positioned in the accelerator cam path.

3. The firearm of claim 2, further including means for retarding the rotation of the breech lever away from the bore axis.

4. The firearm of claim 3, wherein the means for retarding includes a dwell in the breech lever cam path.

5. The firearm of claim 2, wherein the breech lever includes:

a lever arm, the breech lug extending from the lever arm into the breech lever cam path;

a breech pad pivotally coupled to the lever arm, the breech pad having a bearing surface in contact with the cartridge.

6. A firearm for firing a cartridge, comprising:

a magazine having a rearward end and a forward end, the magazine having a receptacle holding one or more cartridges therein;

a barrel having a rearward end and a forward end, the barrel having a bore with a center bore axis extending therethrough;

a receiver having a cavity extending therethrough in communication with the magazine receptacle and the barrel bore such that the bore axis extends through the cavity, the cavity further having a chamber portion adjacent a rearward end of the barrel bore to hold one of the cartridges in a firing position, the receiver including a weapon operating system having:

a slide extending substantially parallel with the bore axis adjacent to the receiver cavity;

a recoil transmitting mechanism coupled to the receiver and in contact with the slide, the recoil transmitting mechanism in communication with the cartridge when the cartridge is in the firing position; and a trigger assembly operable to fire a chambered cartridge, wherein the fired cartridge causes the recoil transmitting mechanism to displace the slide rearwardly;

wherein the firearm is a grenade launcher and the cavity of the receiver is in communication with the magazine receptacle through a positive round control system; and, the positive round control system comprising:

the slide extending substantially parallel with the bore axis adjacent to the receiver cavity, the slide having a recess substantially adjacent a rear end, the slide movable forward and back substantially along the bore axis;

a cartridge carrier having a lifter and at least one cartridge locator for securing a cartridge;

a carrier drive pivotally connected to the cartridge carrier by a carrier pin;

a drive pawl pivotally connected to the carrier drive, the drive pawl engaging the recess of the slide during at least a portion of forward motion of the slide along the bore axis; and, wherein the cartridge carrier is pivotally connected to a carrier link by a link pin so that the carrier drive and the cartridge carrier and the carrier link pivot around the link pin as a functional unit as the slide moves forward and the recess of the slide engages the drive pawl, the functional unit aligning the cartridge secured by the cartridge carrier on the bore axis of the grenade launcher.

7. The firearm of claim 6, wherein the magazine is an onboard magazine positioned behind the cartridge carrier, the receptacle of the onboard magazine storing a plurality of cartridges, each cartridge including a projectile pointing substantially perpendicular to the bore axis.

8. A firearm for firing a cartridge, comprising:

a magazine having a rearward end and a forward end, the magazine having a receptacle holding one or more cartridges therein;

a barrel having a rearward end and a forward end, the barrel having a bore with a center bore axis extending therethrough;

a receiver having a cavity extending therethrough in communication with the magazine receptacle and the barrel bore such that the bore axis extends through the cavity, the cavity further having a chamber portion adjacent a rearward end of the barrel bore to hold one of the cartridges in a firing position, the receiver including a weapon operating system having:

a slide extending substantially parallel with the bore axis adjacent to the receiver cavity;

a recoil transmitting mechanism coupled to the receiver and in contact with the slide, the recoil transmitting mechanism in communication with the cartridge when the cartridge is in the firing position; and a trigger assembly operable to fire a chambered cartridge, wherein the fired cartridge causes the recoil transmitting mechanism to displace the slide rearwardly;

wherein the magazine extends rearwardly from the receiver and is substantially tubular.

9. A firearm for firing a cartridge, comprising:

a magazine having a rearward end and a forward end, the magazine having a receptacle holding one or more cartridges therein;

a barrel having a rearward end and a forward end, the barrel having a bore with a center bore axis extending therethrough;

a receiver having a cavity extending therethrough in communication with the magazine receptacle and the barrel bore such that the bore axis extends through the cavity, the cavity further having a chamber portion adjacent a rearward end of the barrel bore to hold one of the cartridges in a firing position, the receiver including a weapon operating system having:

a slide extending substantially parallel with the bore axis adjacent to the receiver cavity;

a recoil transmitting mechanism coupled to the receiver and in contact with the slide, the recoil transmitting mechanism in communication with the cartridge when the cartridge is in the firing position; and a trigger assembly operable to fire a chambered cartridge, wherein the fired cartridge causes the recoil transmitting mechanism to displace the slide rearwardly;

wherein the magazine extends rearwardly from the receiver and the magazine retains a column of grenade cartridges, each cartridge having a nose and a tail, the tail defining a cartridge rim, the magazine comprising:

at least one interior surface defining a bore for retaining the column of cartridges, the interior surface extending along an axis between a front end and a rear end, the column of cartridges being stacked nose to tail substantially along the axis so that the nose of each cartridge points toward the front end;

a magazine follower positioned at the rear end of the magazine for pushing the column of cartridges toward the front end;

a vernier member having a plurality of cartridge locators, the vernier member riding on a plurality of pins such that the vernier member is movable within the bore from a first position wherein the plurality of cartridge locators are disengaged from the column of cartridges to a second position wherein at least some of the cartridge locators engage the column of cartridges and displace the cartridges so engaged from contacting one another.

10. The firearm of claim 9, wherein the cartridge locators are disengaged from the column of cartridges when the vernier member is in its fully forward position, and wherein the column of cartridges are sequentially separated beginning with the rearmost cartridge when the vernier member is advanced rearward.

11. A firearm for firing a cartridge comprising:

a magazine having a rearward end and a forward end, the magazine having a receptacle holding one or more cartridges therein;

a barrel having a rearward end and a forward end, the barrel having a bore with a center bore axis extending therethrough;

a receiver having a cavity extending therethrough in communication with the magazine receptacle and the barrel bore such that the bore axis extends through the cavity, the cavity further having a chamber portion adjacent a rearward end of the barrel bore to hold one of the cartridges in a firing position, the receiver including a weapon operating system having:

a slide extending substantially parallel with the bore axis adjacent to the receiver cavity;

a recoil transmitting mechanism coupled to the receiver and in contact with the slide, the recoil transmitting mechanism in communication with the cartridge when the cartridge is in the firing position; and a trigger assembly operable to fire a chambered cartridge, wherein the fired cartridge causes the recoil transmitting mechanism to displace the slide rearwardly;

and wherein the recoil transmitting mechanism includes a single lever in contact with the cartridge, the lever pivotally coupled to the receiver at a first location remote from the contact with the cartridge, the lever further including a drive lug engaging a lever cam path in the slide when the cartridge is in the firing position.

12. The firearm of claim 11, wherein the lever further includes a breech pad pivotally coupled to the lever, the breech pad having a bearing surface in contact with the cartridge.

13. A firearm for firing a cartridge, comprising:

a magazine having a rearward end and a forward end, the magazine having a receptacle holding one or more cartridges therein;

a barrel having a rearward end and a forward end, the barrel having a bore with a center bore axis extending therethrough;

a receiver having a cavity extending therethrough in communication with the magazine receptacle and the barrel bore such that the bore axis extends through the cavity, the cavity further having a chamber portion adjacent a rearward end of the barrel bore to hold one of the cartridges in a firing position, the receiver including a weapon operating system having:

a slide extending substantially parallel with the bore axis adjacent to the receiver cavity;

a breech lever substantially adjacent to the cartridge when the cartridge is in the firing position, the breech lever pivotally connected to the receiver at a first location; and an accelerator lever in contact with the breech lever and coupled to the slide when the cartridge is in the firing position, the accelerator lever pivotally connected to the receiver at a second location substantially opposite the first location; and a trigger assembly operable to fire the cartridge in the chamber, wherein the fired cartridge causes the breech lever to direct the accelerator lever against the slide to displace the slide rearwardly.

14. The firearm of claim 13, wherein:

the breech lever includes a breech lug engaging the slide when the cartridge is in the firing position; and the accelerator lever includes an accelerator lug engaging the slide when the cartridge is in the firing position.

15. The firearm of claim 14, wherein the slide includes a breech lever cam path and an accelerator cam path, the breech lug positioned in the breech lever cam path and the accelerator lug positioned in the accelerator cam path.

16. The firearm of claim 15, wherein the breech lever includes:

a lever arm, the breech lug extending from the lever arm into the breech lever cam path; and a breech pad pivotally coupled to the lever arm, the breech pad having a bearing surface in contact with the cartridge.

17. The firearm of claim 16, further including means for retarding the rotation of the breech lever away from the bore axis.

18. The firearm of claim 17, wherein the means for retarding includes a dwell in the breech lever cam path.

19. A firearm for firing a cartridge, comprising:

a barrel having a rearward end and a forward end, the barrel having a bore with a center bore axis extending therethrough;

a magazine having a rearward end and a forward end, the magazine having a receptacle centered about and holding one or more cartridges therein; and a receiver coupled to the rearward end of the barrel, the receiver further being coupled to the forward end of the magazine with at least one spring member therebetween;

wherein the receiver further includes a weapon operating system having:

a chamber for holding one of the cartridges in a firing position;

a slide; and a recoil transmitting mechanism coupled to the receiver and in contact with the slide, the recoil transmitting mechanism in communication with the cartridge when the cartridge is in the firing position wherein the recoil transmitting mechanism includes a single lever in contact with the cartridge, the lever pivotally coupled to the receiver at a first location remote from the contact with the cartridge, the lever further including a drive lug engaging a lever cam path in the slide when the cartridge is in the firing position.

20. The firearm of claim 19, wherein the lever further includes a breech pad pivotally coupled to the lever, the breech pad having a bearing surface in contact with the cartridge.

* * * * *